US009753414B2

(12) United States Patent
Oishi

(10) Patent No.: US 9,753,414 B2
(45) Date of Patent: Sep. 5, 2017

(54) IMAGE FORMING APPARATUS COMPRISING FRICTIONAL FORCE ADJUSTMENT ROLLER AND ADJUSTMENT UNIT

(71) Applicant: FUJI XEROX CO., LTD., Tokyo (JP)

(72) Inventor: Takehiro Oishi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/807,245

(22) Filed: Jul. 23, 2015

(65) Prior Publication Data

US 2016/0282769 A1 Sep. 29, 2016

(30) Foreign Application Priority Data

Mar. 27, 2015 (JP) ..... 2015-067408

(51) Int. Cl.
*G03G 15/16* (2006.01)

(52) U.S. Cl.
CPC ..... *G03G 15/1615* (2013.01)

(58) Field of Classification Search
CPC ..... G03G 15/1615
USPC ..... 399/313, 121
See application file for complete search history.

(56) References Cited

U.S. PATENT DOCUMENTS 9,188,910 B2 * 11/2015 Yoshioka ..... G03G 15/0136
2004/0184845 A1 9/2004 Mitamura et al.
2010/0046991 A1 * 2/2010 Hodoshima ..... G03G 15/1615 399/313
2013/0016984 A1 * 1/2013 Suzuki ..... G03G 15/1615 399/38
2014/0153945 A1 * 6/2014 Yoshioka ..... G03G 15/1615 399/66

FOREIGN PATENT DOCUMENTS

JP 2004-287083 A 10/2004
JP 2007-286383 A 11/2007
JP 2009-042451 A 2/2009
JP 2012-018335 A 1/2012
JP 2012-181352 A 9/2012

* cited by examiner

*Primary Examiner* — Walter L Lindsay, Jr.
*Assistant Examiner* — Arlene Heredia Ocasio
(74) *Attorney, Agent, or Firm* — Oliff PLC

(57) ABSTRACT

Provided is an image forming apparatus including plural image formation units that form an image, an annular belt that holds the image on an outer circumferential surface thereof and transports the image, a driving roller that rotates with being in contact with an inner circumferential surface of the belt and rotates the belt, an adjustment roller that rotates with being in contact with the inner circumferential surface of the belt and adjusts a frictional force generated between the belt and the adjustment roller, a transfer roller that is driven to rotate with being in contact with the outer circumferential surface of the belt and transfers the image on the outer circumferential surface of the belt to a recording medium, and an adjustment unit that adjusts at least one of a rotational speed of the adjustment roller and a normal force of the adjustment roller against the belt.

14 Claims, 11 Drawing Sheets

FIG. 4

| INFORMATION IN CASE WHERE ADJUSTMENT IS PERFORMED | | | CONTENTS OF ADJUSTMENT | |
|---|---|---|---|---|
| | | | NORMAL FORCE | ROTATIONAL SPEED |
| DURING ROTATION START-UP OF INTERMEDIATE TRANSFER BELT | | | ZERO (MINIMUM LEVEL) | ARBITRARY (SAME SPEED) |
| DURING STATIONARY DRIVING | TYPE OF RECORDING SHEET | THICK SHEET | HIGH LEVEL | LOW SPEED |
| | | OTHER SHEETS | NORMAL LEVEL | SAME SPEED |
| | REQUEST LEVEL OF IMAGE QUALITY | HIGH IMAGE QUALITY | HIGH LEVEL | LOW SPEED |
| | | NORMAL IMAGE QUALITY | NORMAL LEVEL | SAME SPEED |

FIG. 5

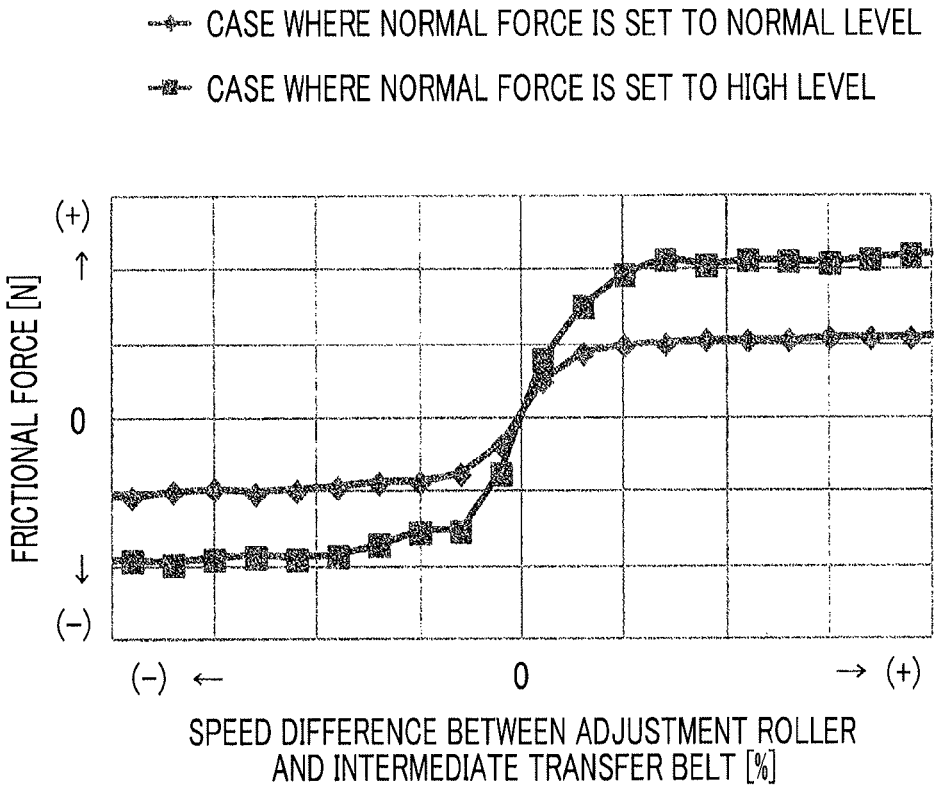

IMAGE FORMING APPARATUS COMPRISING FRICTIONAL FORCE ADJUSTMENT ROLLER AND ADJUSTMENT UNIT

CROSS-REFERENCE TO RELATED APPLICATIONS

This application is based on and claims priority under 35 USC 119 from Japanese Patent Application No. 2015-067408 filed Mar. 27, 2015.

BACKGROUND (i) Technical Field

The present invention relates to an image forming apparatus.

(ii) Related Art

Hitherto, for example, the following apparatus has been known as an image forming apparatus that takes a countermeasure against a problem occurring due to a speed fluctuation of an annular belt (for example, an intermediate transfer belt) which holds images formed by a plural image formation units on the outer circumferential surface thereof and transports the images to a transfer position on a recording medium.

SUMMARY

According to an aspect of the invention, there is provided an image forming apparatus including:

plural image formation units that form an image;

an annular belt that holds the image formed by the plural image formation units on an outer circumferential surface thereof and transports the image;

a driving roller that rotates with being in contact with an inner circumferential surface of the belt and rotates the belt;

an adjustment roller that rotates with being in contact with the inner circumferential surface of the belt and adjusts a frictional force generated between the belt and the adjustment roller;

a transfer roller that is driven to rotate with being in contact with the outer circumferential surface of the belt and transfers the image on the outer circumferential surface of the belt to a recording medium; and an adjustment unit that adjusts at least one of a rotational speed of the adjustment roller and a normal force of the adjustment roller against the belt.

BRIEF DESCRIPTION OF THE DRAWINGS

Exemplary embodiments of the present invention will be described in detail based on the following figures, wherein:

FIG. 3A illustrates a state when adjustment related to a normal force is performed at a high level, FIG. 3B illustrates a state when adjustment related to a normal force is performed at a normal level, and FIG. 3C illustrates a state when adjustment related to a normal force is performed at a minimum level;

FIG. 4 is a table illustrating contents of adjustment performed by the adjustment unit of FIG. 2;

FIG. 5 is a graph showing results of an experiment performed to examine a relationship (characteristics) between a frictional force and a speed difference between an adjustment roller and an intermediate transfer belt;

FIG. 9A illustrates a state when adjustment related to a normal force is performed at a high level, FIG. 9B illustrates a state when adjustment related to a normal force is performed at a normal level, and FIG. 9C illustrates a state when adjustment related to a normal force is performed at a minimum level;

DETAILED DESCRIPTION

Hereinafter, modes for carrying out the invention (hereinafter, simply referred to as "exemplary embodiments") will be described with referring to the accompanied drawings.

First Exemplary Embodiment

Figure 1:
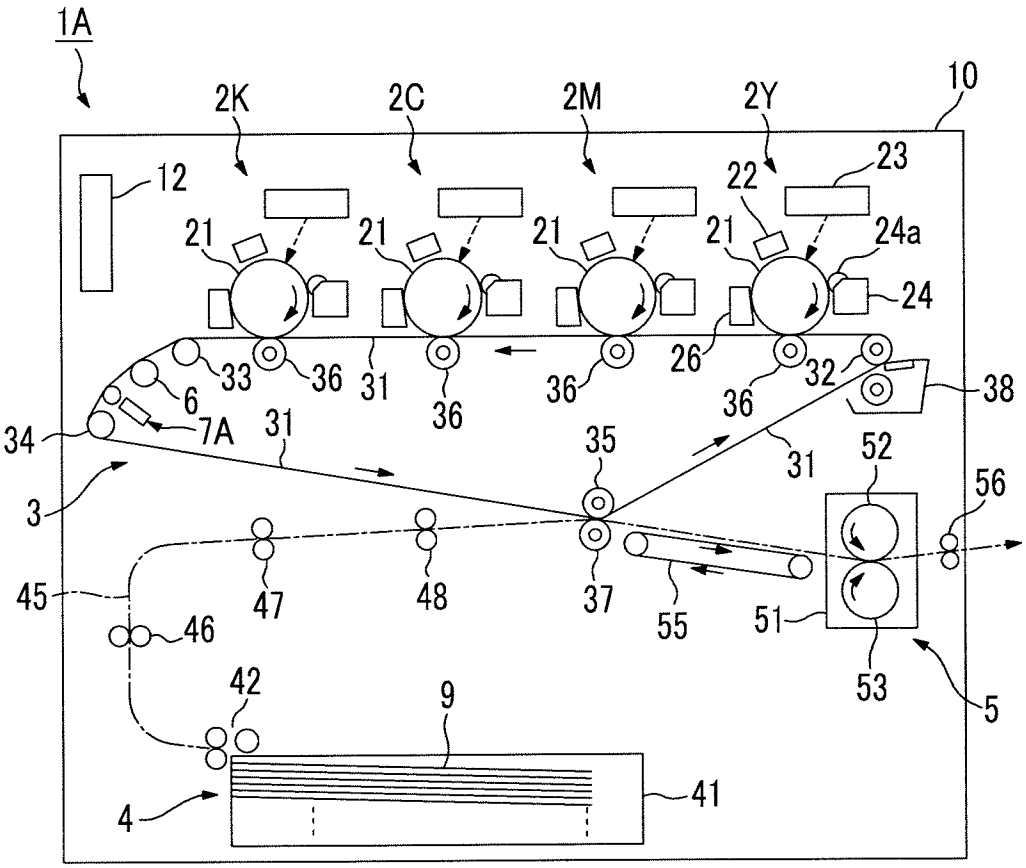
FIG. 1 is a schematic diagram illustrating the configuration of an image forming apparatus according to a first exemplary embodiment.
Figure 2:
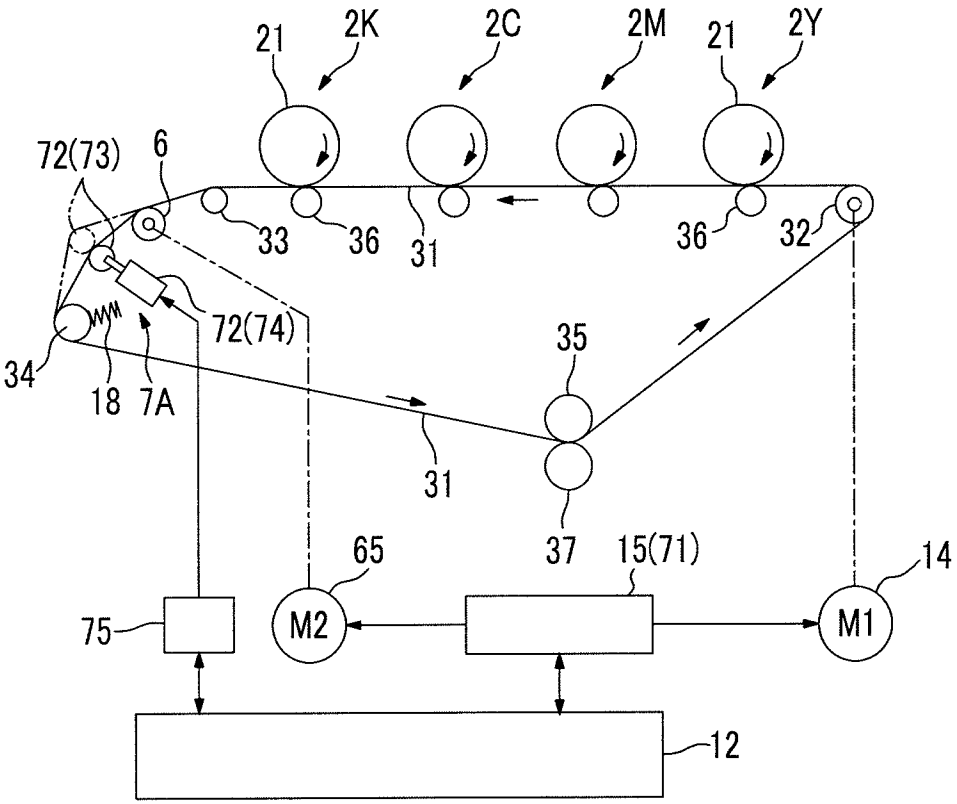
FIG. 2 is a schematic diagram illustrating main components (an adjustment roller and an adjustment unit, and the related parts thereof) in the image forming apparatus of FIG. 1.

FIG. 1 schematically illustrates the entire image forming apparatus according to the first exemplary embodiment, and FIG. 2 schematically illustrates main components (adjustment unit for a speed fluctuation of an intermediate transfer belt) in the image forming apparatus.

Configuration of Image Forming Apparatus

An image forming apparatus 1A according to the first exemplary embodiment forms an image constituted by a developer on a recording sheet 9 as an example of a recording medium, and is configured as, for example, a printer that receives image information input from an external device such as an information terminal to form an image.

The image forming apparatus 1A is provided with plural image formation units 2 that forma toner image developed using a toner as a developer based on input image information, an intermediate transfer unit 3 that holds toner images formed by the respective image formation units 2 and transports the toner images to a secondary transfer position on a recording sheet 9, a sheet feed unit 4 that accommodates and supplies a predetermined recording sheet 9 to be transported to the secondary transfer position of the intermediate transfer unit 3, a fixing unit 5 that passes the recording sheet 9 on which the toner image is transferred by the intermediate transfer unit 3 through to fix the toner image, and the like in the internal space of a housing 10. A dashed line in FIG. 1 indicates a main transporting path when the recording sheet 9 is transported in the internal space of the housing 10, and reference numeral 12 indicates a central control unit that comprehensively controls operations of the respective components of the image forming apparatus 1A.

The plural image formation units 2 are constituted by four image creation devices 2Y, 2M, 2C, and 2K that respectively form toner images constituted by four colors of yellow (Y), magenta (M), cyan (C), and black (K). The four image creation devices 2 (Y, M, C, K) are disposed at a position on the upper side in the internal space of the housing 10 so as to be lined up in series at predetermined intervals (for example, the same interval) in a substantially horizontal direction. In addition, each of the four image creation devices 2 (Y, M, C, K) similarly includes a photosensitive drum 21, a charging device 22, an exposure device 23, a developing device 24, a drum cleaning device 26, a static eliminator (not shown), and the like (these reference numerals of the respective devices are representatively indicated by the image creation device 2Y).

The photosensitive drum 21 is obtained by forming an image holding surface having a photoconductive layer (photosensitive layer) formed of an organic photosensitive material or the like on a circumferential surface of a cylindrical or columnar conductive base material which is grounded. The photosensitive drum is configured to rotate at a predetermined speed in a direction indicated by an arrow by being supplied with power from a rotation driving device not shown in the drawing. The charging device 22 charges the image holding surface of the photosensitive drum 21 to a predetermined charging potential, and is a contact charging device in which a charging voltage is applied to a contact member (for example, a charging roller which is a roller-shaped member, or the like) which is disposed with being in contact with the image holding surface. When the developing device 24 is an apparatus performing reversal development, a voltage having the same polarity as the charge polarity of a toner supplied from the developing device 24 is used as the charging voltage.

The exposure device 23 forms an electrostatic latent image constituted by a predetermined latent image potential by irradiating the charged image holding surface of the photosensitive drum 21 with light (dotted line with an arrow) which is resolved into the four colors, based on image information input to the image forming apparatus 1A. As the exposure device 23, for example, a scanning type exposure device constituted by a semiconductor laser, an optical scanning device, an optical component, and the like or a non-scanning type exposure device constituted by plural light emitting diodes, an optical component, and the like is used. In addition, the exposure device 23 receives an image signal for forming a latent image from an image processing device, not shown in the drawing, which performs a predetermined process on image information input to the image forming apparatus 1A from an external connecting device such as a personal computer terminal.

The developing device 24 includes a developer collection vessel that accommodates a two-component developer (developer including a nonmagnetic toner and a magnetic carrier) as an example of a developer. In addition, the developing device 24 is provided with a development roller 24*a* that holds the developer accommodated in the developer collection vessel while rotating the developer and transports the developer to a development region closely facing the photosensitive drum 21, a stirring and transport member that transports the accommodated two-component developer while rotating and stirring the developer so that the developer passes through the development roller 24*a*, a layer thickness regulation member that regulates the amount (layer thickness) of developer held by the development roller 24*a*, and the like. Further, in the developing device 24, a developing voltage is supplied to the development roller 24*a*, and the development roller 24*a* and the stirring and transport member are supplied with power from a rotation driving device, not shown in the drawing, to rotate in a predetermined direction. As the developing voltage, for example, a direct current on which an alternating current is superimposed is supplied. A toner which is a developer rubs against carriers by being stirred by the stirring and transport member within the developer collection vessel and is frictionally charged to a predetermined polarity (negative polarity in the first exemplary embodiment).

The intermediate transfer unit 3 is disposed at a position on the lower side of the image creation devices 2 (Y, M, C, K) constituting the image creation unit 2.

The intermediate transfer unit 3 is mainly constituted by an intermediate transfer belt 31, plural supporting rollers 32 to 35, a primary transfer device 36, a secondary transfer device 37, and a belt cleaning device 38. The intermediate transfer belt rotates in a direction indicated by an arrow with being in contact with and passes through the photosensitive drums 21 in the respective image creation devices 2 (Y, M, C, K) (at a primary transfer position). The plural supporting rollers rotatably support the intermediate transfer belt 31 by coming into contact with the intermediate transfer belt from the inner circumferential surface thereof and holding the intermediate transfer belt in a desired state. The primary transfer device primarily transfers a toner image formed on the photosensitive drums 21 of the respective image creation devices 2 (Y, M, C, K) onto the intermediate transfer belt 31. The secondary transfer device secondarily transfers the toner image on the intermediate transfer belt 31 onto the recording sheet 9 by pressing the recording sheet 9 against the intermediate transfer belt 31 supported by the supporting roller 35. The belt cleaning device removes impurities such as toner which remains on the intermediate transfer belt 31 after passing through the secondary transfer position constituted by the secondary transfer device 37 and adheres thereto.

As the intermediate transfer belt 31, an annular belt formed of a material in which a resistance adjusting agent such as carbon is dispersed in a synthetic resin such as, for example, a polyimide resin so as to have a predetermined thickness is used. Regarding the plural supporting rollers 32 to 35, the supporting roller 32 serves as a driving roller that rotates the intermediate transfer belt 31, the supporting roller 33 serves as a levelling roller that forms and holds a primary transfer surface of the intermediate transfer belt 31, the supporting roller 34 serves as a tension application roller that applies a predetermined amount of tension to the intermediate transfer belt 31, and the supporting roller 35 serves as a backup roller of secondary transfer. Among these rollers, the supporting rollers 33 to 35 are driven to rotate with being in contact with the inner circumferential surface of the intermediate transfer belt 31. In addition, the supporting roller 32 as a driving roller is configured to receive power from an electric motor M1 to be described later and a rotation driving device 14 (FIG. 2) constituted by a rotation transmission mechanism or the like to rotate at a predetermined speed V1 in a predetermined direction.

The primary transfer device 36 is a contact transfer device including a contact member that is driven to rotate with being in contact with the image holding surface of the photosensitive drum 21 after development (with the intermediate transfer belt 31 interposed therebetween) and is supplied with a voltage for primary transfer. As the contact member, a primary transfer roller which is a roller-shaped member that is driven to rotate with being in contact with the roller-shaped member to be described later from the inner circumferential surface of the intermediate transfer belt and pressing the intermediate transfer belt 31 against the image holding surface of the photosensitive drum 21 is used. As the voltage for primary transfer, a direct-current voltage (direct-current voltage having a polarity opposite to a charge polarity of a toner) is supplied.

The secondary transfer device 37 is a contact transfer device including a contact member that forms a secondary transfer pressure contact portion with being in contact with the intermediate transfer belt 31 supported by the supporting roller 35 as a backup roller of secondary transfer from the outer circumferential surface thereof and pressing the intermediate transfer belt with a predetermined amount of pressure. As the contact member, a secondary transfer roller as a roller-shaped member that is driven to rotate with being in contact with a portion of the intermediate transfer belt supported by the supporting roller 35 from the outer circumferential surface thereof at a predetermined pressure is used. In addition, the secondary transfer device 37 supplies a voltage for secondary transfer to the secondary transfer roller or supporting roller 35. As the voltage for secondary transfer, a direct-current voltage having the same polarity as a charge polarity of a toner is supplied when being supplied to the supporting roller 35, and a direct-current voltage having a polarity opposite to the charge polarity of the toner is supplied when being supplied to the secondary transfer device 37.

The sheet feed unit 4 is disposed at a position on the lower side of the intermediate transfer unit 3.

The sheet feed unit 4 is installed so as to be extracted to the front side surface (side surface to which a user is opposite during operation) side of the housing 10. The sheet feed unit mainly includes a single or plural containers 41 that accommodate the recording sheets 9 having desired sizes and types carried therein, and a sending-out device 42 that sends out the recording sheets 9 one by one from the container 41. A sheet feed transporting path 45 that transports the recording sheet 9 sent out from the sheet feed unit 4 to the secondary transfer position of the intermediate transfer unit 3 is provided in the internal space of the housing 10. The sheet feed transporting path 45 includes plural transport roller pairs 46 and 47, a transport guide member not shown in the drawing, and the like. Among these, a transport roller pair 48 is configured as a sending-out (resist) roller pair having a function of correcting a transport timing and a transport state of the recording sheet 9.

The fixing unit 5 is disposed at a position on the sheet output side of the secondary transfer position in the intermediate transfer unit 3.

The fixing unit 5 is configured such that a roller- or belt-type heating rotating member 52 and a roller- or belt-type pressing rotating member 53 are installed within a housing 51. The heating rotating member rotates in a direction indicated by an arrow and is heated by a heating unit so that the surface temperature thereof is maintained at a predetermined temperature. The pressing rotating member is driven to rotate with being in contact with the heating rotating member at a predetermined pressure substantially along the axial direction of the heating rotating member 52. The heating rotating member 52 receives power from a rotation driving device not shown in the drawing to rotate at a predetermined speed in a predetermined direction. In addition, a belt-type sheet transport device 55 and an output roller pair 56 are provided in the internal space of the housing 10. The belt-type sheet transport device is provided between the secondary transfer unit of the intermediate transfer unit 3 and the fixing unit 5 and transports the recording sheet 9 after secondary transfer to the fixing unit 5. The output roller pair is provided between the fixing unit 5 and a sheet output port of the housing 10, and transports and outputs the recording sheet 9 after fixing toward an output accommodation unit, not shown in the drawing, which is disposed outside the housing 10.

In addition, the image forming apparatus 1A has at least a full color mode and a monochromatic mode. The full color mode is an image creation pattern for forming a full color image constituted by toner images of four colors (Y, M, C, K) formed using all of the four image creation devices 2 (Y, M, C, K) in the image creation unit 2. The monochromatic mode is an image creation pattern for forming a monotone image constituted by a toner image of a single color formed using one of the four image creation devices 2 (Y, M, C, K). The monochromatic mode in the first exemplary embodiment is set as a black-and-white mode for forming a black-and-white image constituted by a toner image of a black color (K).

Image Forming Operation Using Image Forming Apparatus

Next, a basic image forming operation using the image forming apparatus 1A will be described.

Here, operations in a case where a full color image is formed based on a full color mode will be representatively described as an example.

First, as illustrated in FIG. 1, in the four image creation devices 2 (Y, M, C, K), when image formation based on a full color mode is performed, each of the photosensitive drums 21 rotates in a direction indicated by an arrow, and the charging device 22 charges the image holding surface of the photosensitive drum 21 thereof to a predetermined polarity (negative polarity in the first exemplary embodiment) and potential based on a charging voltage. Subsequently, each of the exposure device 23 performs exposure based on an image signal resolved to each color component (Y, M, C, K) on the photosensitive drum 21 after charging to form an electrostatic latent image of the color component constituted by predetermined potential on the image holding surface of the photosensitive drum 21.

Subsequently, in the four image creation devices 2 (Y, M, C, K), each of the developing devices 24 performs development by supplying a toner of each color (Y, M, C, K) charged to a predetermined polarity (negative polarity) to the portion of the electrostatic latent image of each color component formed on the photosensitive drum 21 from a development roller 24*a* and electrostatically attaching the toner to the portion of the latent image of the photosensitive drum 21 by a developing electric field formed by a developing voltage. A toner image of any one color of the four colors (Y, M, C, K) is formed on the image holding surface of the photosensitive drum 21 in the image creation devices 2 (Y, M, C, K) by the development. In other words, for example, a toner image of a yellow color is formed on the photosensitive drum 21 of the image creation device 2Y, and a toner image of a magenta color is formed on the photosensitive drum 21 of the image creation device 2M.

Subsequently, in primary transfer positions of the respective image creation devices 2 (Y, M, C, K), the primary transfer device 36 primarily transfers toner images of four colors formed on the respective photosensitive drums 21 in sequential order (in the order of Y, M, C, and K) to the outer circumferential surface of the intermediate transfer belt 31 of the intermediate transfer unit 3 by a transfer electric field formed by a primary transfer voltage.

Subsequently, the intermediate transfer unit 3 holds the toner images, which are primarily transferred to the outer circumferential surface of the intermediate transfer belt 31, by the intermediate transfer belt 31 rotating in the direction indicated by an arrow and transports the toner images to the secondary transfer position. Then, at the secondary transfer position, the secondary transfer device (secondary transfer roller) 37 secondarily transfers the toner images collectively to the recording sheet 9 transported to the secondary transfer position through the transporting path 45 for sheet feeding from the sheet feed unit 4 by a transfer electric field formed by a secondary transfer voltage.

Subsequently, the recording sheet 9 having the toner image secondarily transferred thereonto in the intermediate transfer unit 3 is peeled off from the intermediate transfer belt 31 and is then transported so as to be sent into the fixing unit 5 by the sheet transport device 55. At this time, in the fixing unit 5, the recording sheet 9 is introduced into a fixing pressure contact portion in which the heating rotating member and the pressing rotating member 53 are brought into press-contact with each other and is made to pass through the fixing pressure contact portion to be heated and pressed. Thereby, the toner image is melted to be fixed onto the recording sheet 9. Subsequently, the recording sheet 9 having the toner image fixed thereon in the fixing unit 5 is output from the fixing unit 5 and is then output to the outside of the housing 10 by the output roller pair 56, and is finally accommodated in an output container not shown in the drawing.

By the above-described operations, one recording sheet 9 having a full color image, constituted by a combination of toner images of four colors, formed on one surface thereof is output, and the image forming operation of the full color mode is terminated.

Fluctuation Phenomenon of Rotational Speed of Intermediate Transfer Belt

Incidentally, in the image forming apparatus 1A, as described below, a rotational speed of the intermediate transfer belt 31 in the intermediate transfer unit 3 may fluctuate.

For example, when the secondary transfer process of the toner image is performed in the above-mentioned image forming operation, the recording sheet 9 is plunged into the secondary transfer unit (portion in which the intermediate transfer belt 31 supported by the supporting roller 35 and the secondary transfer roller 37 of the secondary transfer device are brought into press-contact with each other) of the intermediate transfer unit 3. At this time, a load is applied to the intermediate transfer belt 31 and the like. Thereby, a phenomenon in which the intermediate transfer belt 31 expands and contracts or the shaft of the supporting roller is distorted occurs. As a result, the rotational speed of the intermediate transfer belt 31 instantaneously fluctuates.

Such a fluctuation in the rotational speed in the intermediate transfer belt 31 tends to become prominent, particularly, when a so-called thick sheet is used as the recording sheet 9. In addition, in an image forming apparatus of an intermediate transfer system which forms a multi-color image using plural image formation units forming a toner image and the like, there is a tendency for the intermediate transfer belt to expand and contract due to a relative increase in the circumference of the intermediate transfer belt, which results in a tendency for the rotational speed of the intermediate transfer belt to vary.

Figure 12:
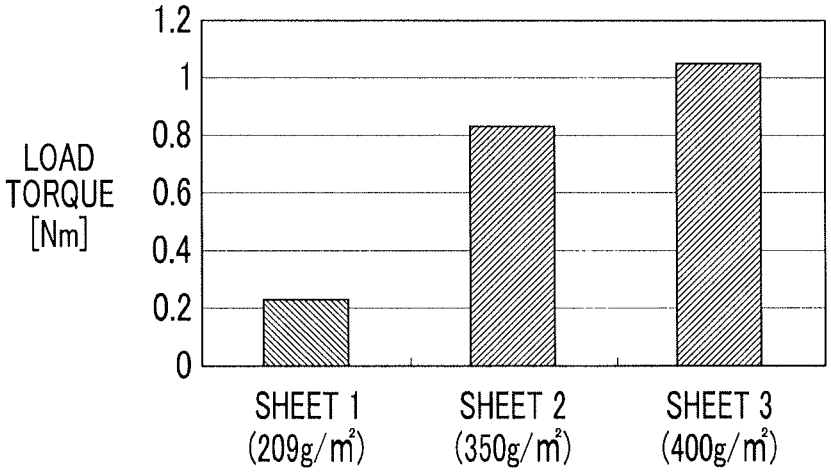
FIG. 12 is a graph illustrating results obtained by measuring load fluctuations in a secondary transfer unit when a recording sheet is plunged.

FIG. 12 illustrates results obtained by measuring load fluctuations in the secondary transfer unit when the recording sheet 9 is plunged. This measurement is performed by measuring a load torque of the driving roller 32 of the intermediate transfer belt 31 by a torque measurement device using three types of sheets 1 to 3. At this time, all of the sheets 1 to 3 are plain sheets, but basis weight ($g/m^2$) as one index of the thickness of a recording sheet is different for each sheet as indicated by a numerical value in a parenthesis. From the results shown in the same drawing, it is understood that a load torque in the driving roller 32 in the cases of the sheets 2 and 3 equivalent to a thickness (for example, basis weight of 350 $g/m^2$ to 400 $g/m^2$) referred to as a so-called thick sheet increases by approximately four to five times as compared to a load torque in the case of the sheet 1 equivalent to a general thickness (for example, basis weight of 200 $g/m^2$ to 2.50 $g/m^2$).

Incidentally, according to the research of the present inventor, it is confirmed that it is not possible to suppress the expansion and contraction of the intermediate transfer belt when the recording medium is plunged into the secondary transfer unit, for example, in spite of adopting a measure for increasing the strength of the shaft of the supporting roller. In addition, even when a measure for suppressing fluctuations in rotational speed in the intermediate transfer belt 31 is adopted, it is confirmed that another problem may be caused depending on the contents of the measure.

Detailed Configurations of Main Components of Image Forming Apparatus

Consequently, as illustrated in FIGS. 1 to 3C and the like, a configuration is adopted in which the image forming apparatus 1A is provided with an adjustment roller 6 and an adjustment unit 7A. The adjustment roller adjusts a frictional force generated between the adjustment roller and the intermediate transfer belt 31 by rotating with being in contact with the inner circumferential surface of the intermediate transfer belt 31. The adjustment unit adjusts at least one of the rotational speed of the adjustment roller 6 and a normal force of the adjustment roller 6 against the intermediate transfer belt 31.

Figure 3A:
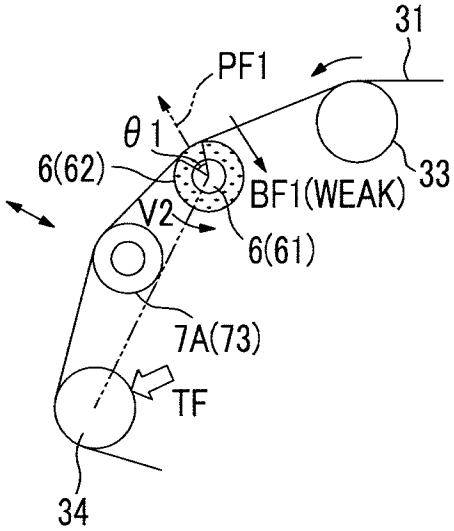
FIGS. 3A to 3C are diagrams illustrating operation states of the adjustment roller and the adjustment unit of FIG. 2.
Figure 3B:
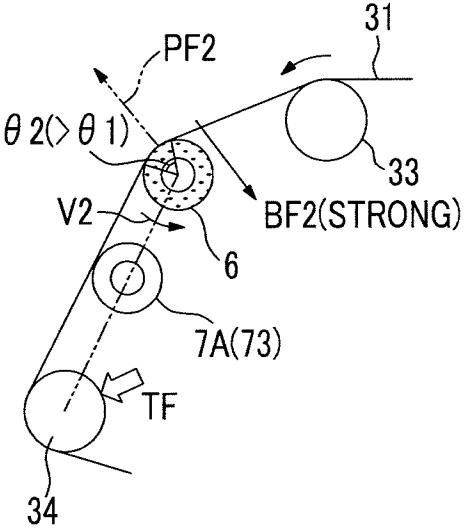
Figure 3C:
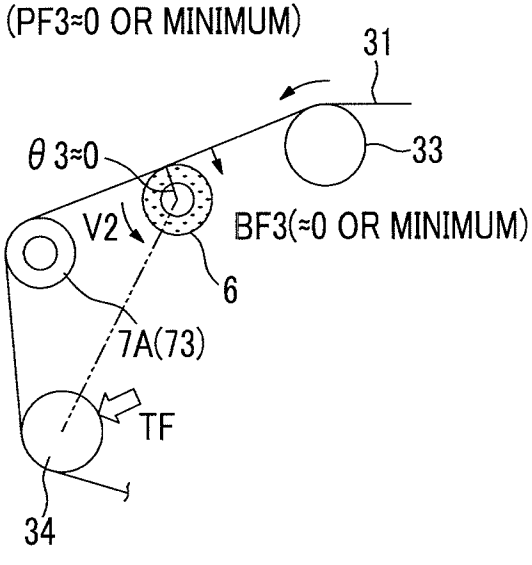

The adjustment roller 6 is disposed at a position where the adjustment roller is able to come into contact with the inner circumferential surface of the portion of the intermediate transfer belt 31 between the supporting roller 33 as a levelling roller and the supporting roller 34 as a tension application roller so that the adjustment roller is set to be in a rotatable state at the position which is fixed. As the adjustment roller 6, as illustrated in FIGS. 3A to 3C, a roller including a roller-shaped base material 61 formed of a metal or the like, an elastic layer 62, formed of rubber, which is provided in the vicinity of the roller-shaped base material 61, and the like is used. In particular, the elastic layer 62 is configured such that a predetermined frictional force is generated between the elastic layer and the inner circumferential surface of the intermediate transfer belt 31 when being in contact with the inner circumferential surface of the intermediate transfer belt 31 which rotates. For example, the adjustment roller 6 may be further provided with a surface layer, formed of a material having high frictionality against (the inner circumferential surface of) the intermediate transfer belt 31, on the surface of the elastic layer 62 in order to secure the frictional force.

In addition, as illustrated in FIG. 2, the adjustment roller 6 receives rotational power from a rotation driving device 65 constituted by an electric motor M2, a rotation transmission mechanism, and the like to rotate at a predetermined rotational speed V2 in a predetermined direction. The rotation direction at this time is the same as the rotation direction of the intermediate transfer belt 31. In addition, the rotational speed V2 at this time is two types of speeds (the same speed and a low speed) based on the rotational speed V1 of the intermediate transfer belt 31 as described later. Reference numeral 18 in FIG. 2 is a spring member for applying a predetermined amount of tension TF by pressing the supporting roller 34 as a tension application roller along a tension application direction.

As the adjustment unit 7A, a unit capable of adjusting both the rotational speed of the adjustment roller 6 and a normal force of the adjustment roller 6 against the intermediate transfer belt 31 is adopted. The adjustment unit 7A includes, for example, a speed adjustment unit 71 that adjusts the rotational speed V2 of the adjustment roller 6 and a normal force adjustment unit 72 that moderates the normal force PF of the adjustment roller 6 against the intermediate transfer belt 30.

Here, the normal force PF of the adjustment roller 6 against the intermediate transfer belt 31 means a force (reaction force) generated toward a direction opposite to a pressing direction of a pressing force BF, against the pressing force BF applied to the adjustment roller 6 so that the adjustment roller 6 is pressed from the intermediate transfer belt 31 when the adjustment roller 6 is being in contact with the intermediate transfer belt 31 applied with the tension TF (see FIGS. 3A to 3C and the like).

The speed adjustment unit 71 is configured to be incorporated into a rotation driving control unit (control device) 15 used to control operations (including a rotational speed) of an electric motor and the like in each rotation driving device including the image forming apparatus 1A. For this reason, the rotation driving control unit 15 controls the operation (of the electric motor and the like) of the rotation driving device 14 of the driving roller 32 in the intermediate transfer unit 3. In particular, the rotation driving control unit 15 is configured to control the rotational speed V2 related to the adjustment roller 6 in the rotation driving device 65 of the adjustment roller 6 according to the following content based on the rotational speed V1 of the driving roller 32 of the intermediate transfer belt 31.

That is, the rotation driving control unit 15 in the first exemplary embodiment converts the rotational speed V2 of the adjustment roller 6 into any one of the same rotational speed as the rotational speed V1 of the driving roller 32 and a rotational speed lower than the rotational speed V1 of the driving roller 32 as illustrated in FIG. 4. The same rotational speed means a rotational speed when the rotational speed V2 of the adjustment roller 6 is set to have the same value as the rotational speed V1 by control or a rotational speed when a speed difference between the rotational speed V2 and the rotational speed V1 is set to fall within, for example, approximately 0.3% or less. On the other hand, the low rotational speed refers to a rotational speed when a speed difference between the rotational speed V2 of the adjustment roller 6 and the rotational speed V1 of the driving roller 32 is set to fall within, for example, approximately from 0.3% to 1%.

The rotation driving control unit 15 is constituted by a storage unit constituted by a storage element such as, for example, a read only memory (ROM), or an external storage device, an arithmetic processing apparatus, an input and output device, a control device, and the like, and performs necessary control operations for the operations of the rotation driving device based on contents of a program, data, and the like stored in the storage unit and the like. In addition, the rotation driving control unit 15 is configured to receive a predetermined information signal transmitted from, for example, the central control unit 12 of the image forming apparatus 1A and to rotate based on the information signal. Meanwhile, the rotation driving control unit 15 may be configured as a control unit independent of the central control unit 12 of the image forming apparatus 1A or may be configured as a control unit integrally formed as a portion of the central control unit 12.

The normal force adjustment unit 72 in the first exemplary embodiment is constituted by a first adjustment device that increases and decreases a contact area between the adjustment roller 6 and the intermediate transfer belt 31. A normal force adjustment unit 72A constituted by the first adjustment device is driven to rotate with being in contact with the inner circumferential surface of the intermediate transfer belt 31 near the adjustment roller 6, and includes a displacement roller 73 which is displaced and a displacement mechanism 74 that displaces the displacement roller 73 in a direction (displacement direction) substantially perpendicular to a direction when moving by the rotation of the intermediate transfer belt 31 and holds the displacement roller.

The displacement roller 73 is installed at a position capable of coming into contact with the inner circumferential surface of the portion of the intermediate transfer belt 31 between the adjustment roller 6 and the supporting roller 34 as a tension application roller so as to be able to move and rotate along the displacement direction with respect to a supporting frame not shown in the drawing. As the displacement roller 73, a roller formed of, for example, a metal is used.

The displacement mechanism 74 may reciprocate the displacement roller 73 in the displacement direction by a predetermined distance and may hold the displacement roller. As the displacement mechanism 74, a device including a combination of a mechanism, which is constituted by, for example, a rack and a gear, and a driving device rotating the gear is used. That is, the device is configured such that the gear and the driving device are disposed at a supporting frame rotatably supporting the displacement roller 73 and that the gear is set to engage with the rack. The device is a device capable of reciprocating the supporting frame of the displacement roller 73 in the displacement direction by rotating the gear.

In addition, the displacement mechanism 74 is configured to control an operation of displacing the displacement roller 73 (specifically, an operation of the driving device) by a displacement control unit 75. As illustrated in FIGS. 3A to 3C and the like, the displacement control unit 75 controls an operation of displacing the displacement roller 73 to a predetermined position in order to adjust a contact area between the adjustment roller 6 and the intermediate transfer belt 31, that is, a wrap angle (central angle within a winding range) θ at which the adjustment roller comes into contact with the inner circumferential surface of the intermediate transfer belt 31 at each level (angle) to be described later.

As illustrated in FIGS. 3A to 3C, FIG. 4, and the like, the displacement control unit 75 of the displacement mechanism 74 in the first exemplary embodiment is configured to control an operation related to a displacement position of the displacement roller 73 so that any one of a normal level in the case of holding at a reference wrap angle θ1, a high level in the case of holding at a wrap angle θ2 larger than the wrap angle θ1 at the normal level, and a minimum level in the case of holding at a minimum wrap angle θ3 of approximately zero or close to zero is set. Rephrasing the levels, the normal level is equivalent to a case where a normal force (PF1) of the adjustment roller 6 against the intermediate transfer belt 31 is at a normal level, the high level is equivalent to a case where a normal force (PF2) of the adjustment roller 6 against the intermediate transfer belt 31 is at a relatively high level, and the minimum level is equivalent to a case where a normal force (PF3) of the adjustment roller 6 against the intermediate transfer belt 31 is at the relatively lowest level or level of zero.

The displacement control unit 75 is configured in substantially the same manner as the rotation driving control unit 15 mentioned above. In addition, the displacement control unit 75 is also configured to receive a predetermined information signal transmitted from, for example, the central control unit 12 of the image forming apparatus 1A and to operate and stop based on the information signal.

The image forming apparatus 1A is set such that a rotational speed of the adjustment roller 6 and a normal force of the adjustment roller 6 against the intermediate transfer belt 31 are adjusted to each rotational speed and each level by the adjustment unit 7A (actually, the speed adjustment unit 71 and the normal force adjustment unit 72) based on (by taking advantage of) pieces of information such as an operation timing of the intermediate transfer belt 31, the type of the recording sheet 9, and a request level of an image quality as illustrated in FIG. 4. Setting information regarding the adjustment operation is stored in storage elements of the driving control unit 71 of the speed adjustment unit 71 and the driving control unit 75 of the adjustment roller 6, or is stored in a storage element of the central control unit 12.

Specifically, first, the adjustment unit 7A is set to perform adjustment separately during rotation start-up and stationary driving of the driving roller 32 based on information regarding the operation timing of the intermediate transfer belt 31 (the driving roller 32 in the present example).

Figure 6:
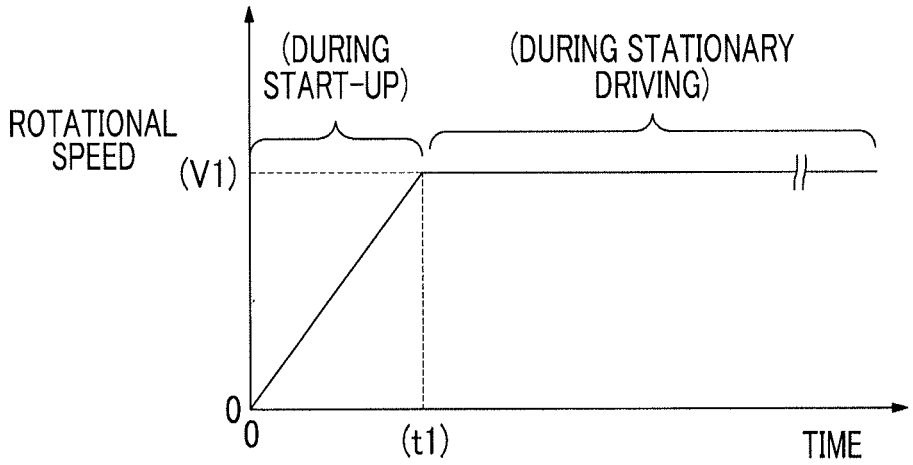
FIG. 6 is a diagram illustrating a case of rotation start-up and a case of stationary driving of an intermediate transfer belt.

Here, the rotation start-up of the driving roller 32 refers to a period of time (time t1) between the start of the rotation of the driving roller 32 and the attainment of the driving roller to a rotational speed V1 set in advance as illustrated in FIG. 6. In addition, the stationary driving of the driving roller 32 refers to a period of time during which the driving roller 32 keeps rotating at the rotational speed V1 after its rotation start-up. In principle, the stationary driving is also equivalent to a period of time during which an image forming operation based on the image forming apparatus 1A is started and is being performed. Regarding the information regarding the operation timing of the intermediate transfer belt 31, for example, when the central control unit 12 receives a signal for instructing the start of an image forming operation, the received information is used as information regarding the start of the rotation start-up. At this time, a configuration is adopted such that the elapse of time between a point in time of the rotation start-up of the driving roller 32 and the attainment of the driving roller to a time (t1 of FIG. 6) which is set in advance is measured by a timer or the like, and information when the time elapses is obtained as information regarding the termination of the rotation start-up and information regarding the start of the stationary driving. These pieces of information are obtained by being transmitted to, for example, the central control unit 12 or the driving control units 71 and 75 in the adjustment unit 7A.

In addition, the adjustment unit 7A is set to perform adjustment separately in a case where the recording sheet 9 actually used for an image forming operation is a thick sheet and a case where the recording sheet is a sheet other than a thick sheet, based on information regarding the type (a difference in thickness in the present example) of the recording sheet 9.

Here, the thick sheet targets a recording sheet having a basis weight of, for example, 350 g/m$^2$ or more. However, the above-mentioned thick sheet does not target a recording sheet having as large a thickness as not being capable of being applied to an image forming operation (operations which are mainly related to sheet transport, and transfer and fixing processes) based on the image forming apparatus 1A. Information regarding the thickness of the recording sheet 9 is obtained as information set by a sheet type setting unit capable of setting information regarding the type of the recording sheet 9, which also includes information regarding the thickness of a sheet, or is obtained as information set by a sheet thickness setting unit capable of setting thickness information of the recording sheet 9 accommodated in the sheet feed unit 4.

Further, the adjustment unit 7A is set to perform adjustment separately in a case where a request level of an image quality selected by a user of the image forming apparatus is a high image quality and a case where the request level is a normal image quality other than the high image quality, based on information of the request level.

Here, the high image quality refers to an image quality of an image with a relatively high quality which is obtained when an image forming operation is performed under special conditions partially different from conditions in the case of a normal image quality. Information regarding the request level of the image quality is obtained as information, for example, when being selected by a user using an image quality selection unit capable of selecting an image quality level in an external device or an operation setting unit of the image forming apparatus 1A.

Operations Related to Main Components of Image Forming Apparatus

Hereinafter, operations related to the adjustment roller 6 and the adjustment unit 7A in the image forming apparatus 1A will be described.

Adjustment During Rotation Start-Up

First, when the central control unit 12 or the like receives an instruction for a start request of an image forming operation, the image forming apparatus 1A determines that the driving roller 32 of the intermediate transfer belt 31 which has stopped rotating until then is at a timing of rotation start-up. Accordingly, as illustrated in FIG. 4, the normal force adjustment unit 72 of the adjustment unit 7A adjusts a normal force of the adjustment roller 6 against the intermediate transfer belt 31 to a minimum level, and the speed adjustment unit 71 of the adjustment unit 7A adjusts a rotational speed V2 of the adjustment roller 6 to the same speed as the rotational speed V1 of the driving roller 32 of the intermediate transfer belt 31.

Specifically, the normal force adjustment unit 72 is configured such that the displacement control unit 75 controls the displacement mechanism 74 so as to perform a displacement operation corresponding to the minimum level. Thereby, as illustrated in FIG. 3C, the displacement roller 73 is displaced to a position where the wrap angle θ3 between the adjustment roller 6 and the intermediate transfer belt 31 is set to approximately zero. The displacement position of the displacement roller 73 at this time is set to be, for example, a position where the intermediate transfer belt 32 may be displaced so as to set a state where the inner circumferential surface of the intermediate transfer belt 31 does not come into contact with the adjustment roller 6 at all or comes into contact with the adjustment roller very slightly. Meanwhile, the displacement position of the displacement roller 73 in FIG. 3C is exaggeratingly illustrated for convenience of description by giving priority to the ease of understanding.

By the adjustment related to a normal force, as illustrated in FIG. 3C, the adjustment roller 6 is set to be in a state where the inner circumferential surface of the intermediate transfer belt 31 does not come into contact with or slightly comes into contact with the surface of the roller, and thus the adjustment roller hardly receives a pressing force BF3 from the intermediate transfer belt 31 (BF3~0). As a result, the normal force PF3 of the adjustment roller 6 against the intermediate transfer belt 31 is set to zero or a minimum (PF3~0 or a minimum). Thereby, a frictional force between the adjustment roller 6 and the intermediate transfer belt 31 is set to approximately zero because the normal force PF is hardly generated. Incidentally, the frictional force is generated substantially in proportion to (force of a component along a movement direction of the intermediate transfer belt 31 of) the normal force PF.

On the other hand, the speed adjustment unit 71 is configured such that the rotation driving control unit 15 controls the rotation driving device 65 so as to perform a driving operation at the above-mentioned rotational speed. By the adjustment related to a rotational speed, the adjustment roller 6 is started to rotate so that the rotational speed thereof reaches the same rotational speed V1 as that of the driving roller 32.

When the adjustment during rotation start-up is performed, the intermediate transfer belt 31 does not receive an excessive frictional resistance from the adjustment roller 6, and an excessive load is also not applied to the rotation driving device 65 of the driving roller 32 that rotates the intermediate transfer belt 31. As a result, the intermediate transfer belt 31 is started to smoothly rotate by receiving power of the driving roller 32 that is normally started to rotate. Thereby, the intermediate transfer belt 31 normally reaches a desired rotational speed (V1) at a time (t1) which is set in advance.

On the other hand, if a normal force PF of the adjustment roller 6 against the intermediate transfer belt 31 during rotation start-up is adjusted to a normal level or a high level, the intermediate transfer belt 31 receives frictional resistance from the adjustment roller 6. Accordingly, an excessive load is applied to the rotation driving device 65 of the driving roller 32, and thus the intermediate transfer belt 31 is not started to rotate as scheduled. For this reason, for example, the start of an image forming operation (primary transfer of a toner image to the intermediate transfer belt 31, or the like) before the intermediate transfer belt 31 reaches a desired rotational speed (at a timing when rotation is not sufficient or is unstable) may cause a problem such as defective transfer.

In this regard, such a problem does not occur in the image forming apparatus 1A. Meanwhile, since the adjustment roller 6 hardly affects the rotation start-up of the intermediate transfer belt 31 during the rotation start-up, it may be said that the rotational speed V2 of the adjustment roller 6 is not necessarily set to be the same speed as the rotational speed V1 of the driving roller 32. For this reason, the adjustment related to the rotational speed V2 of the adjustment roller 6 during rotation start-up may be arbitrarily performed (FIG. 4), and there is no particular problem if the rotational speed of the adjustment roller is adjusted to, for example, a speed lower than the rotational speed V1 of the driving roller 32.

Adjustment During Stationary Driving (when a Recording Sheet is a Sheet Other than a Thick Sheet and a Request Level of an Image Quality is a Normal Image Quality)

Subsequently, at a timing when the driving roller 32 of the intermediate transfer belt 31 reaches a desired rotational speed V1 (when time t1 elapses from a point in time of the rotation start), the image forming apparatus 1A determines that the intermediate transfer belt 31 is set to be at a timing of stationary driving. Accordingly, as illustrated in FIG. 4, the normal force adjustment unit 72 of the adjustment unit 7A adjusts a normal force of the adjustment roller 6 against the intermediate transfer belt 31 to a normal level except for at least one of a case where the recording sheet 9 is a thick sheet and a case where a request level of an image quality is a high image quality. At this time, the speed adjustment unit 71 of the adjustment unit 7A is maintained in a state of the same adjustment operation as during the rotation start-up of the intermediate transfer belt 31. That is, the rotational speed V2 of the adjustment roller 6 is continuously adjusted to the same speed as the rotational speed V1 of the driving roller 32 of the intermediate transfer belt 31.

Specifically, the normal force adjustment unit 72 is configured such that the displacement control unit 75 controls the displacement mechanism 74 so as to perform a displacement operation corresponding to a normal level. Thereby, as illustrated in FIG. 3A, the displacement roller 73 is displaced to a position where a wrap angle θ1 between the adjustment roller 6 and the intermediate transfer belt 31 is set to an angle which is set in advance. The displacement position of the displacement roller 73 at this time is set to be a position where, for example, the intermediate transfer belt 31 may be displaced so as to set a state where the inner circumferential surface thereof slightly is being in contact with the adjustment roller 6 (for example, the same degree of state as the supporting roller 33 as a levelling roller).

By the adjustment related to a normal force, as illustrated in FIG. 3A, the adjustment roller 6 is set to be in a state where the inner circumferential surface of the intermediate transfer belt 31 slightly comes into contact with the surface of the adjustment roller, and thus the adjustment roller receives a certain degree of (slight) pressing force BF1 from the intermediate transfer belt 31. As a result, a state where a certain degree of normal force PF1 of the adjustment roller 6 against the intermediate transfer belt 31 is generated is set. The normal force PF1 at this time becomes relatively smaller than a normal force PF2 in a case where adjustment to a high level to be described later is performed (PF1<PF2). Thereby, a frictional force between the adjustment roller 6 and the intermediate transfer belt 31 is obtained at a level which is substantially proportional to the magnitude of the normal force PF1.

On the other hand, the adjustment roller 6 at this time continues to rotate at the same rotational speed V1 as that of the driving roller 32 by the adjustment of the speed adjustment unit 71.

When the adjustment during stationary driving (when the recording sheet 9 is another sheet and a request level of an image quality is a normal image quality) is performed, the intermediate transfer belt 31 rotates by continuing to receive a certain degree of frictional resistance from the adjustment roller 6. At this time, since the adjustment roller 6 is rotating at the same rotational speed V1 as that of the driving roller 32, the intermediate transfer belt 31 does not receive friction (resistance) caused by a speed difference between the intermediate transfer belt and the adjustment roller 6.

As a result, even when a speed fluctuation occurs due to the expansion and contraction of the intermediate transfer belt 31 in a case where the recording sheet 9 (recording sheet other than a thick sheet) is plunged into the secondary transfer unit by the image forming operation under the adjustment, it is possible to suppress the propagation of an influence caused by the expansion and contraction so as to reach a primary transfer surface in the image creation device 2 (particularly, the image creation device 2K) through a belt portion on the side where the adjustment roller 6 is disposed. In other words, the propagation of the influence caused by the expansion and contraction of the intermediate transfer belt 31 is almost blocked and disappears when passing through the adjustment roller 6 in which a frictional force is generated due to the speed fluctuation. On the other hand, the influence caused by the expansion and contraction of the intermediate transfer belt 31 is small because of a decrease in the amount of propagation of the influence to the primary transfer surface in the image creation device 2 (particularly, the image creation device 2Y) through a belt portion on the side where the driving roller 32 is disposed. This is because a state where the intermediate transfer belt 31 is wound around the driving roller 32 over a relatively wide range (a state where a wrap angle is extremely large) is set, and thus it is considered that the propagation is suppressed to be reduced in the portion of the driving roller 32.

In addition, in the adjustment during stationary driving, adjustment related to a normal force using the normal force adjustment unit 72 is performed at a normal level and is not performed at a high level. For this reason, a frictional force between the adjustment roller 6 and the inner circumferential surface of the intermediate transfer belt 31 is suppressed to an appropriate amount without becoming excessive, and thus friction in the inner circumferential surface of the intermediate transfer belt 31 is not likely to occur.

As a result, if the friction occurs, a coefficient of friction in the inner circumferential surface of the intermediate transfer belt 31 varies (mainly decreases), which may result in a disadvantage such as a reduction in an effect of suppressing a speed fluctuation using the adjustment roller 6 due to a fluctuation in a relationship of a frictional force between the inner circumferential surface of the intermediate transfer belt and the adjustment roller 6, or a tendency for the intermediate transfer belt 31 to slide between the driving roller 32 and the intermediate transfer belt. However, when the above-mentioned adjustment is performed, the occurrence of such a disadvantage is suppressed.

Adjustment During Stationary Driving (at Least One of a Case where a Recording Sheet is a Thick Sheet and a Case where a Request Level of an Image Quality is a High Image Quality)

In addition, the image forming apparatus 1A is configured such that, at a timing during the above-mentioned stationary driving, in either a case where information on usage of a thick sheet as the recording sheet 9 is acquired or a case where information on a request of a high image quality as a request level of an image quality is acquired, as illustrated in FIG. 4, the normal force adjustment unit 72 of the adjustment unit 7A adjusts a normal force of the adjustment roller 6 against the intermediate transfer belt 31 to a high level and the speed adjustment unit 71 of the adjustment unit 7A adjusts the rotational speed V2 of the adjustment roller 6 to a speed lower than the rotational speed V1 of the driving roller 32 of the intermediate transfer belt 31.

Specifically, the normal force adjustment unit 72 is configured such that the displacement control unit 75 controls the displacement mechanism 74 so as to perform a displacement operation corresponding to a high level. Thereby, as illustrated in FIG. 3B, the displacement roller 73 is displaced to a position where a wrap angle θ2 between the adjustment roller 6 and the intermediate transfer belt 31 is set to be an angle which is set in advance. The displacement position of the displacement roller 73 at this time is set to be, for example, a position where the intermediate transfer belt 31 may be displaced so that the inner circumferential surface thereof is in contact with the adjustment roller 6 over a relatively wide range. In addition, the wrap angle θ2 is set to be larger than the wrap angle θ1 in a case where adjustment to the above-mentioned normal level is performed (θ2>θ1).

By the adjustment related to a normal force, as illustrated in FIG. 3B, the adjustment roller 6 is set to be in a state where the inner circumferential surface of the intermediate transfer belt 31 comes into more contact with the surface of the adjustment roller over a wider range, and thus the adjustment roller receives a relatively large (strong) pressing force BF2 from the intermediate transfer belt 31. As a result, a normal force PF2 of the adjustment roller 6 against the intermediate transfer belt 31 is increased. In other words, the normal force PF2 at this time becomes relatively larger than the normal force PF1 in a case where adjustment to the above-mentioned normal level is performed (PF2>PF1). Thereby, a frictional force between the adjustment roller 6 and the intermediate transfer belt 31 is obtained as a relatively high level substantially proportional to the magnitude of the normal force PF2.

On the other hand, the speed adjustment unit 71 is configured such that the driving control unit 15 controls the rotation driving device 65 so as to perform a driving operation at a rotational speed V2 lower than a rotational speed V1. Thereby, the adjustment roller 6 rotates at the rotational speed V1 lower than the rotational speed V1 of the driving roller 32.

When the adjustment during stationary driving is performed, the intermediate transfer belt 31 rotates by continuing to receive a relatively large frictional resistance from the adjustment roller 6.

Here, a state under adjustment will be described using characteristics illustrated in FIG. 5. First, FIG. 5 illustrates both a case where a normal force of the adjustment roller 6 against the intermediate transfer belt 31 is set to be in a normal level and a case where the normal force is set to be in a high level, with regard to a relationship between a frictional force and a difference in speed between the adjustment roller 6 and the intermediate transfer belt 31. The characteristic results are obtained by an experiment performed to examine a frictional force applied to the intermediate transfer belt 31 by the adjustment roller 6 based on contents assuming the intermediate transfer unit 3, the adjustment roller 6, and the adjustment unit 7A in the image forming apparatus 1A. In FIG. 5, a portion having a large inclination of the graph line indicates that a frictional force varies greatly, and indicates that a frictional force varies more greatly as the inclination becomes larger. In contrast, a portion having a small inclination indicates that a frictional force varies little.

From the results illustrated in FIG. 5, it may be understood that a variation in the frictional force depending on the difference in speed becomes greater in a case where a normal force of the adjustment roller 6 against the intermediate transfer belt 31 is adjusted to a high level than in a case where the normal force is adjusted to a normal level. From this, when the adjustment during stationary driving is performed (particularly, when adjustment related to the normal force is performed at a high level), a frictional force of the adjustment roller 6 increases more against the intermediate transfer belt 31 in a case where a speed has fluctuated, and acts on the intermediate transfer belt. Therefore, it may be understood that it is possible to obtain a state where an effect of suppressing a speed fluctuation of the intermediate transfer belt 31 using the adjustment roller 6 is exhibited most strongly.

For this reason, when the recording sheet 9 which is a thick sheet is particularly plunged into a secondary transfer unit by an image forming operation under the adjustment, the intermediate transfer belt 31 expands and contracts greatly, which results in a great fluctuation in the speed thereof. It is possible to effectively suppress the propagation of an influence caused by the expansion and contraction so as to reach a primary transfer surface in the image creation device 2 (particularly, the image creation device 2K) through a belt portion on the side where the adjustment roller 6 is disposed. In other words, the propagation of the influence caused by the expansion and contraction of the intermediate transfer belt 31 is almost blocked and disappears in the adjustment roller 6 in which a stronger frictional force may be generated when a difference in speed occurs. On the other hand, for the above-described reason, the influence caused by the expansion and contraction of the intermediate transfer belt 31 is small because of a decrease in the amount of propagation of the influence to the primary transfer surface in the image creation device 2 (particularly, image creation device 2Y) through a belt portion on the side where the driving roller 32 is disposed.

In addition, even when a recording sheet other than a thick sheet is plunged into the secondary transfer unit as the recording sheet 9 in an image forming operation when a request level of an image quality is a high image quality under the adjustment, it is possible to reliably suppress the propagation of influence caused by the expansion and contraction of the intermediate transfer belt 31 so as to reach a primary transfer surface in the image creation device 2 (particularly, the image creation device 2K) through a belt portion on the side where the adjustment roller 6 is disposed. In other words, an effect of suppressing a speed fluctuation of the intermediate transfer belt 31 using the adjustment roller 6, which is effective even in the case of a thick sheet, further effectively acts on the recording sheet 9 having a thickness smaller than that of the thick sheet.

On the other hand, in the adjustment during stationary driving, the adjustment roller 6 rotates at a rotational speed V2 lower than the rotational speed V1 of the driving roller 32. For this reason, the adjustment roller 6 rotates with a speed difference (difference of approximately 0.3%) with respect to the intermediate transfer belt 31.

Thereby, it is possible to decrease, even a little, a variation in a frictional force of the adjustment roller 6 against the intermediate transfer belt 31 when a difference in speed between the adjustment roller 6 and the intermediate transfer belt 31 occurs (see FIG. 5, the inclination decreases even a little). As a result, even when a slight speed fluctuation occurs in the adjustment roller 6, there is an advantage that the propagation of the fluctuation to the intermediate transfer belt 31 is suppressed.

On the other hand, if adjustment for setting the rotational speed V2 of the adjustment roller 6 to be the same speed as the rotational speed V1 of the driving roller 32 is performed during the stationary driving, a speed fluctuation caused by factors (for example, a rotational fluctuation of the rotation driving device 65 and the eccentricity of the roller) of a slight speed fluctuation of the adjustment roller 6 results in an excessive increase in a change of the amount of friction occurring due to the speed fluctuation (see FIG. 5). As a result, there is a concern that a disadvantage that the speed fluctuation of the adjustment roller 6 is transmitted to the intermediate transfer belt 31 may occur.

In this regard, in the adjustment during stationary driving, such a disadvantage does not occur.

Incidentally, regarding adjustment related to the rotational speed V2 of the adjustment roller 6 during stationary driving, a configuration may be adopted in which the rotational speed V2 of the adjustment roller 6 is adjusted to a speed higher than the rotational speed V1 of the driving roller 32 from the viewpoint of preferably generating a slight speed difference between the intermediate transfer belt 31 and the adjustment roller. It is preferable that the speed difference in this case is the same level as that in the above-described case of being set to a low speed.

Second Exemplary Embodiment

Figure 7:
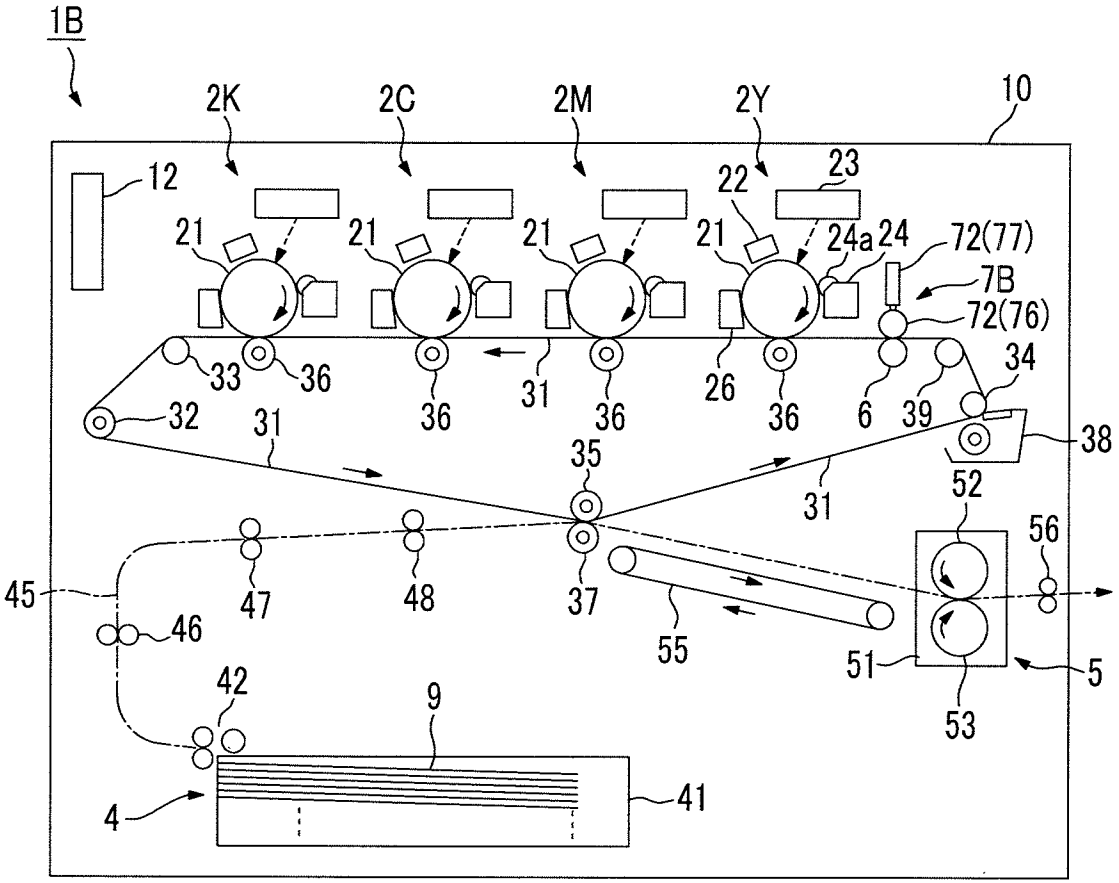
FIG. 7 is a schematic diagram illustrating the configuration of an image forming apparatus according to a second exemplary embodiment.

FIG. 7 schematically illustrates the configuration of an image forming apparatus 1B according to the second exemplary embodiment.

The image forming apparatus 1B is different from the image forming apparatus 1A (FIG. 1) according to the first exemplary embodiment in that the installation position of an adjustment roller 6 is changed, an adjustment unit 7A is changed to an adjustment unit 7B having a different configuration, and the positions of a driving roller 32 and a supporting roller 34 are changed. The other configurations are the same as those of the image forming apparatus 1A according to the first exemplary embodiment. Hereinafter, different portions will be mainly described.

Figure 8:
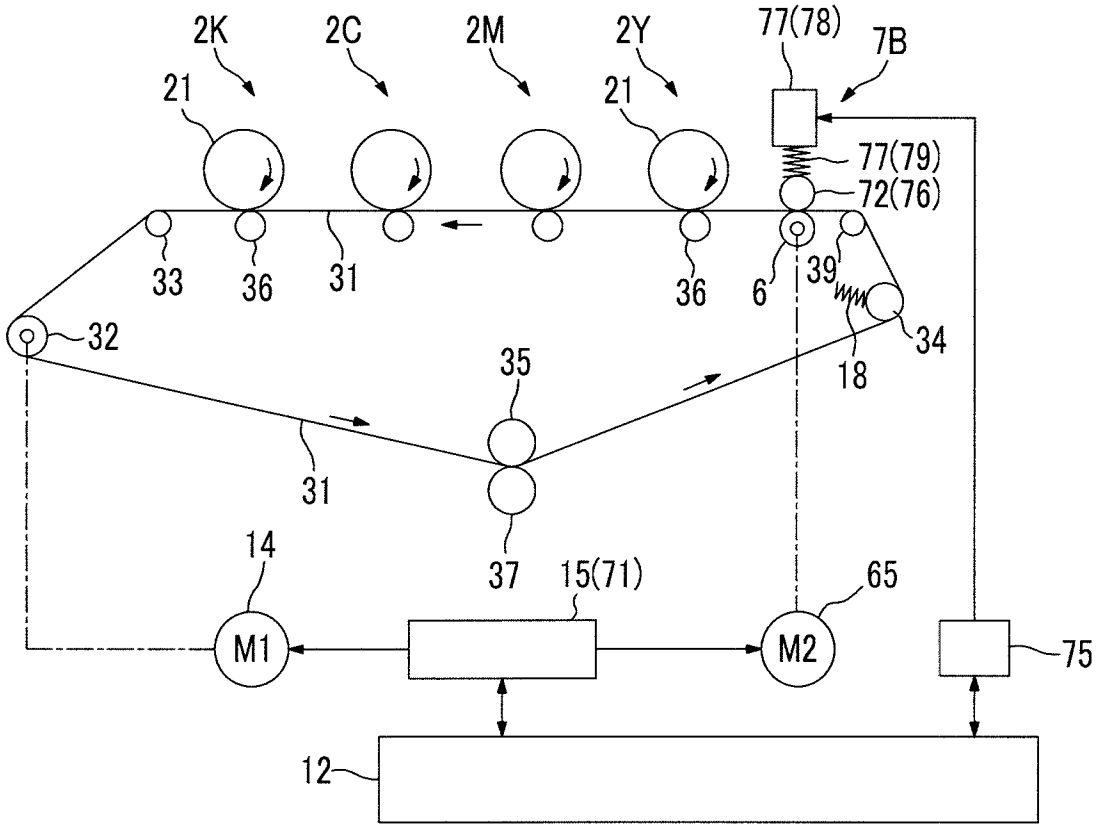
FIG. 8 is a schematic diagram illustrating main components (an adjustment roller and an adjustment unit, and the related parts thereof) in the image forming apparatus of FIG. 7.

In the image forming apparatus 1B, as illustrated in FIG. 7, FIG. 8, and the like, an adjustment roller 6 is installed within a range from a secondary transfer unit to an image creation device 2Y toward the downstream side of an intermediate transfer belt 31 in a rotation direction. Actually, the adjustment roller 6 is installed so as to be driven and rotate with being in contact with the inner circumferential surface side of the intermediate transfer belt 31 at a position between the image creation device 2Y and a supporting roller 39 for levelling which is added in association with a change in the installation position of the adjustment roller 6 (strictly, a change to an adjustment unit 7B). Other configurations in the adjustment roller 6 are the same as those of the adjustment roller 6 in the first exemplary embodiment.

Meanwhile, in the image forming apparatus 1B, the position of a driving roller 32 is changed to a position between an image creation device 2K and a secondary transfer unit in the intermediate transfer belt 31 from the viewpoint of suppressing the propagation of vibration, which is generated when a recording sheet 9 is plunged, from the secondary transfer unit to the upstream side of the intermediate transfer belt 31 in the rotation direction by changing the adjustment roller 6 (and the adjustment unit 7B) to the installation position. In addition, a change in the position of the supporting roller 34 which is a tension application roller is performed in association with a change in the installation position of the driving roller 32.

In addition, the adjustment unit 7B adopts a unit capable of adjusting both a rotational speed of the adjustment roller 6 and a normal force of the adjustment roller 6 against the intermediate transfer belt 31. Specifically, the adjustment unit is the same as the adjustment unit 7A in the first exemplary embodiment in that the adjustment unit includes a speed adjustment unit 71 adjusting a rotational speed V2 of the adjustment roller 6 and a normal force adjustment unit 72 moderating a normal force PF of the adjustment roller 6 against the intermediate transfer belt 31. However, the adjustment unit is different from the adjustment unit 7A in the first exemplary embodiment in that the following unit having a different configuration is adopted as the normal force adjustment unit 72.

That is, as illustrated in FIG. 7, FIG. 8, and the like, the normal force adjustment unit 72 in the adjustment unit 7B is constituted by a second adjustment device that increases and decreases a contact pressure of the adjustment roller 6 which is received from the intermediate transfer belt 31. The normal force adjustment unit 72 constituted by the second adjustment device includes a displacement roller 76 and a displacement mechanism 77. The displacement roller is driven to rotate with being in contact with the outer circumferential surface of the intermediate transfer belt 31 at a position where the displacement roller faces the adjustment roller 6 with the intermediate transfer belt 31 interposed therebetween, and is displaced. The displacement mechanism displaces the displacement roller 76 in a direction substantially perpendicular to a direction when the intermediate transfer belt 31 rotates and moves, in other words, in a direction (displacement direction) in which the displacement roller approaches and recedes from the adjustment roller 6, and holds the displacement roller.

The displacement roller 76 of the normal force adjustment unit 72 has the same configuration as that of the displacement roller 73 of the normal force adjustment unit 72 in the first exemplary embodiment.

In addition, the displacement mechanism 77 of the normal force adjustment unit 72 has a function of reciprocating the displacement roller 76 by a predetermined distance in the displacement direction thereof and holding the displacement roller. As the displacement mechanism 77, a device including a combination of a mechanism, which is constituted by, for example, a rack and a gear, and a driving device rotating the gear is used similarly to the displacement mechanism 74 in the first exemplary embodiment, or a device including a combination of a cam mechanism and a driving device rotating the cam is used. Meanwhile, the displacement mechanism 77 is configured to displace the displacement roller 76 through a spring member 79.

Figure 9A:
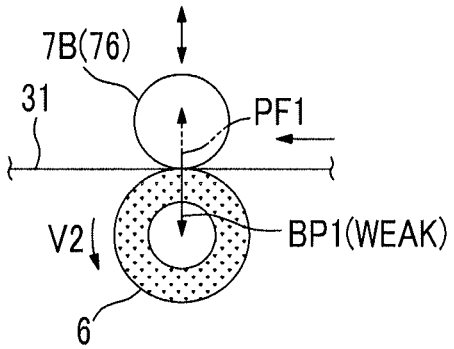
FIGS. 9A to 9C are diagrams illustrating operation states of the adjustment roller and the adjustment unit of FIG. 8.
Figure 9B:
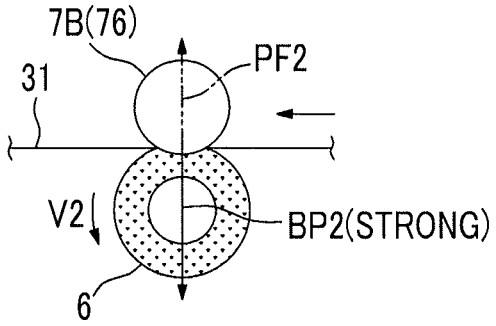
Figure 9C:
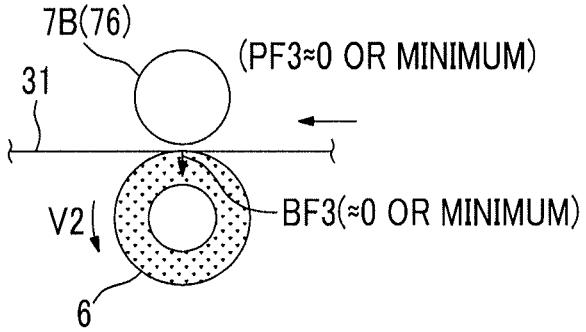

In addition, the displacement mechanism 77 is configured to control an operation of displacing the displacement roller (specifically, an operation of a driving device that actually performs displacement) by a displacement control unit 75. As illustrated in FIGS. 9A to 9C and the like, the displacement control unit 75 is configured to control an operation of displacing the displacement roller 76 to a predetermined position with respect to the intermediate transfer belt 31 and the adjustment roller 6 in order to adjust a contact pressure BP of the adjustment roller 6 which is received from the intermediate transfer belt 31 to each level to be described later.

As illustrated in FIG. 8, FIGS. 9A to 9C, and the like, the displacement control unit 75 of the displacement mechanism is configured to control an operation related to a displacement position of the displacement roller 76 so that any one of a normal level in the case of holding at a reference contact pressure BP1, a high level in the case of holding at a contact pressure BP2 higher than the contact pressure BP1 at the normal level, and a minimum level in the case of holding at a minimum contact pressure BP3 of approximately zero or close to zero is set. Rephrasing the levels, similarly to the cases of the levels in the first exemplary embodiment, the normal level is equivalent to a case where a normal force (PF1) of the adjustment roller 6 against the intermediate transfer belt 31 is at a normal level, the high level is equivalent to a case where a normal force (PF2) of the adjustment roller 6 against the intermediate transfer belt 31 is a relatively high level, and the minimum level is equivalent to a case where a normal force (PF3) of the adjustment roller 6 against the intermediate transfer belt 31 is relatively a lowest level or a zero level.

The other configurations of the displacement control unit 75 are the same as those in the case of the displacement control unit 75 in the first exemplary embodiment.

The image forming apparatus 1B is set such that a rotational speed of the adjustment roller 6 and a normal force of the adjustment roller 6 against the intermediate transfer belt 31 are adjusted to each level and each rotational speed by the adjustment unit 7B (actually, the speed adjustment unit 71 and the normal force adjustment unit 72) based on pieces of information such as an operation timing of the intermediate transfer belt 31, the type of recording sheet 9, and a request level of an image quality as illustrated in FIG. 4. The setting contents are the same' as the adjustment contents of the adjustment unit 7A in the first exemplary embodiment.

Operations Related to Main Components of Image Forming Apparatus

Hereinafter, operations related to the adjustment roller 6 and the adjustment unit 7B in the image forming apparatus 1B will be described. Incidentally, operations at this time are substantially the same as the operations related to the adjustment roller 6 and the adjustment unit 7B in the image forming apparatus 1A described above according to the first exemplary embodiment.

Adjustment During Rotation Start-Up

In the image forming apparatus 1B, first, when a central control unit 12 or the like receives an instruction for the start of an image forming operation, the normal force adjustment unit 72 of the adjustment unit 7B adjusts a normal force of the adjustment roller 6 against the intermediate transfer belt 31 to a minimum level, and the speed adjustment unit 71 of the adjustment unit 7A adjusts a rotational speed V2 of the adjustment roller 6 to the same speed as the rotational speed V1 of the driving roller 32 of the intermediate transfer belt 31, as illustrated in FIG. 4.

Specifically, the normal force adjustment unit 72 is configured such that the displacement control unit 75 controls the displacement mechanism 74 so as to perform a displacement operation corresponding to the minimum level. Thereby, as illustrated in FIG. 9C, the displacement roller 76 is displaced to a position in the adjustment roller 6 at which the contact pressure BP3 received from the intermediate transfer belt 31 is set to approximately zero. The displacement position of the displacement roller 76 at this time is set to be, for example, a position where the displacement roller 76 may displace a displacement roller 86 so as to set a state where the displacement roller 76 does not come into contact with the outer circumferential surface of the intermediate transfer belt 31 at all or comes into contact with the outer circumferential surface very slightly. Meanwhile, in this case, even when the displacement roller 76 does not come into contact with the outer circumferential surface of the intermediate transfer belt 31 at all, the adjustment roller 6 strictly receives slight pressure based on the empty weight of the intermediate transfer belt due to a light contact between the intermediate transfer belt 31 and the surface of the adjustment roller.

By the adjustment related to a normal force, as illustrated in FIG. 9C, the adjustment roller 6 hardly receives the contact pressure BP3 from the intermediate transfer belt 31 (BF3≈0 or minimum). As a result, a normal force PF3 of the adjustment roller 6 against the intermediate transfer belt 31 is set to approximately zero (PF3≈0 or minimum). Thereby, a frictional force between the adjustment roller 6 and the intermediate transfer belt 31 at this time is set to approximately zero because the normal force PF is hardly generated.

On the other hand, the speed adjustment unit 71 is configured such that the driving control unit 71 controls the rotation driving device 65 so as to perform a driving operation at the above-mentioned rotational speed. By the adjustment related to a rotational speed, the adjustment roller 6 is started to rotate so that the rotational speed thereof reaches the same rotational speed V1 as that of the driving roller 32.

Similarly to the case of the adjustment in the first exemplary embodiment, when the adjustment during rotation start-up is performed, the intermediate transfer belt 31 does not receive an excessive frictional resistance from the adjustment roller 6, and an excessive load is not also applied to the rotation driving device 65 of the driving roller 32 that rotates the intermediate transfer belt 31. As a result, the intermediate transfer belt 31 is started to smoothly rotate by receiving power of the driving roller 32 that is normally started to rotate. Thereby, the intermediate transfer belt 31 normally reaches a desired rotational speed (V1) at a time (t1) which is set in advance.

Adjustment During Stationary Driving (when a Recording Sheet is a Sheet Other than a Thick Sheet and a Request Level of an Image Quality is a Normal Image Quality)

Subsequently, when the image forming apparatus 1B determines that the intermediate transfer belt 31 is set to be at a timing of stationary driving, the normal force adjustment unit 72 of the adjustment unit 7B adjusts a normal force of the adjustment roller 6 against the intermediate transfer belt 31 to a normal level except for at least one of a case where the recording sheet 9 is a thick sheet and a case where a request level of an image quality is a high image quality, as illustrated in FIG. 4. Meanwhile, the speed adjustment unit 71 of the adjustment unit 7B is maintained in a state of the same adjustment operation as during the rotation start-up of the intermediate transfer belt 31.

Specifically, the normal force adjustment unit 72 is configured such that the displacement control unit 75 controls the displacement mechanism 74 so as to perform a displacement operation corresponding to a normal level. Thereby, as illustrated in FIG. 9A, the displacement roller 76 is displaced to a position where the displacement roller slightly comes into contact with the outer circumferential surface of the intermediate transfer belt 31. The displacement position of the displacement roller 76 at this time is set to be a position where, for example, the intermediate transfer belt 31 is slightly pressed against the adjustment roller 6.

By the adjustment related to a normal force, as illustrated in FIG. 9A, the adjustment roller 6 is set to be in a state where the inner circumferential surface of the intermediate transfer belt 31 slightly comes into contact with the surface of the adjustment roller, and thus the adjustment roller receives a certain degree of (lower) contact pressure BP1 from the intermediate transfer belt 31. As a result, a state where a certain degree of normal force PF1 of the adjustment roller 6 against the intermediate transfer belt 31 is generated is set. The normal force PF1 at this time becomes relatively smaller than a normal force PF2 in a case where adjustment to a high level to be described later is performed (PF1<PF2). Thereby, a frictional force between the adjustment roller 6 and the intermediate transfer belt 31 is obtained at a level which is substantially proportional to the magnitude of the normal force PF1.

On the other hand, the adjustment roller 6 at this time continues to rotate at the same rotational speed V1 as that of the driving roller 32 by the adjustment of the speed adjustment unit 71.

When the adjustment during stationary driving (when the recording sheet 9 is another sheet and a request level of an image quality is a normal image quality) is performed, the intermediate transfer belt 31 rotates by continuing to receive a certain degree of frictional resistance from the adjustment roller 6. At this time, since the adjustment roller 6 rotates at the same rotational speed V1 as that of the driving roller 32, the intermediate transfer belt 31 does not receive friction (resistance) caused by a speed difference between the intermediate transfer belt and the adjustment roller 6.

As a result, even when a speed fluctuation occurs due to the expansion and contraction of the intermediate transfer belt 31 in a case where the recording sheet 9 (which is not a thick sheet) is plunged into the secondary transfer unit by the image forming operation under the adjustment, it is possible to suppress the propagation of an influence caused by the expansion and contraction so as to reach a primary transfer surface in the image creation device 2 (particularly, the image creation device 2Y) through a belt portion on the side where the adjustment roller 6 is disposed. In other words, the propagation of the influence caused by the expansion and contraction of the intermediate transfer belt 31 is almost blocked and disappears when passing through the adjustment roller 6 in which a frictional force is generated due to the speed fluctuation. On the other hand, the influence caused by the expansion and contraction of the intermediate transfer belt 31 is little because of a decrease in the amount of propagation of the influence to the primary transfer surface in the image creation device 2 (particularly, the image creation device 2K) through a belt portion on the side where the driving roller 32 is disposed, in substantially the same manner as the case of the adjustment in the second exemplary embodiment.

In addition, in the adjustment during stationary driving, adjustment related to a normal force using the normal force adjustment unit 72 is performed at a normal level and is not performed at a high level. For this reason, a frictional force between the adjustment roller 6 and the inner circumferential surface of the intermediate transfer belt 31 is suppressed to an appropriated amount without becoming excessive, and thus friction in the inner circumferential surface of the intermediate transfer belt 31 is not likely to occur.

Adjustment During Stationary Driving (at Least One of a Case where a Recording Sheet is a Thick Sheet and a Case where a Request Level of an Image Quality is a High Image Quality)

In addition, the image forming apparatus 1B is configured such that, at a timing during the above-mentioned stationary driving, in either a case where information on usage of a thick sheet as the recording sheet 9 is acquired or a case where information on a request of a high image quality as a request level of an image quality is acquired, as illustrated in FIG. 4, the normal force adjustment unit 72 of the adjustment unit 7B adjusts a normal force of the adjustment roller 6 against the intermediate transfer belt 31 to a high level and that the speed adjustment unit 71 of the adjustment unit 7A adjusts the rotational speed V2 of the adjustment roller 6 to a speed lower than the rotational speed V1 of the driving roller 32 of the intermediate transfer belt 31.

Specifically, the normal force adjustment unit 72 is configured such that the displacement control unit 75 controls the displacement mechanism 74 so as to perform a displacement operation corresponding to a high level. Thereby, as illustrated in FIG. 9B, the displacement roller 76 is displaced to a position where the intermediate transfer belt 31 is strongly pressed against the surface of the adjustment roller 6. The displacement position of the displacement roller 76 at this time is set to be, for example, a position where the intermediate transfer belt 31 may be displaced so that the inner circumference of the intermediate transfer belt 31 is in contact with the surface of the adjustment roller 6 more strongly and over a wider range.

By the adjustment related to a normal force, as illustrated in FIG. 9B, the adjustment roller 6 is set to be in a state where the inner circumferential surface of the intermediate transfer belt 31 comes into more contact with the surface of the adjustment roller over a wider range, and thus the adjustment roller receives a relatively large (strong) pressing force BF2 from the intermediate transfer belt 31. The contact pressure BP2 at this time is set to be pressure larger than the contact pressure BP2 in a case where adjustment to the above-mentioned normal level is performed (BP2>BP1). As a result, a normal force PF2 of the adjustment roller 6 against the intermediate transfer belt 31 increases. In other words, the normal force PF2 at this time becomes relatively larger than the normal force PF1 in a case where adjustment to the above-mentioned normal level is performed (PF2>PF1). Thereby, a frictional force between the adjustment roller 6 and the intermediate transfer belt 31 is obtained as a relatively high level substantially in proportional to the magnitude of the normal force PF2.

On the other hand, the speed adjustment unit 71 is configured such that the driving control unit 71 (15) controls the rotation driving device 65 so as to perform a driving operation at a rotational speed V2 lower than a rotational speed V1. Thereby, the adjustment roller 6 rotates at the rotational speed V1 lower than the rotational speed V1 of the driving roller 32.

When the adjustment during stationary driving is performed, the intermediate transfer belt 31 rotates by continuing to receive a relatively large frictional resistance from the adjustment roller 6.

Incidentally, when the adjustment during stationary driving is performed (particularly, when adjustment related to the normal force is performed at a high level), a frictional force of the adjustment roller 6 increases more against the intermediate transfer belt 31 in a case where a speed has fluctuated, and acts on the intermediate transfer belt (see FIG. 5) for the same reasons as in the case of the adjustment in the first exemplary embodiment. Therefore, it is possible to obtain a state where an effect of suppressing a speed fluctuation of the intermediate transfer belt 31 using the adjustment roller 6 is exhibited most strongly.

For this reason, when the recording sheet 9 which is a thick sheet is particularly plunged into a secondary transfer unit by an image forming operation under the adjustment, the intermediate transfer belt 31 expands and contracts greatly, which results in a great fluctuation in the speed thereof. It is possible to effectively suppress the propagation of an influence caused by the expansion and contraction so as to reach a primary transfer surface in the image creation device 2 (particularly, the image creation device 2Y) through a belt portion on the side where the adjustment roller 6 is disposed. In other words, the propagation of the influence caused by the expansion and contraction of the intermediate transfer belt 31 is almost blocked and disappears in the adjustment roller 6 in which a stronger frictional force may be generated when a difference in speed occurs. On the other hand, for the above-described reason, the influence caused by the expansion and contraction of the intermediate transfer belt 31 is little because of a decrease in the amount of propagation of the influence to the primary transfer surface in the image creation device 2 (particularly, image creation device 2K) through a belt portion on the side where the driving roller 32 is disposed.

In addition, even when a recording sheet other than a thick sheet is plunged into the secondary transfer unit as the recording sheet 9 in an image forming operation when a request level of an image quality is a high image quality under the adjustment, it is possible to reliably suppress the propagation of an influence caused by the expansion and contraction of the intermediate transfer belt 31 so as to reach a primary transfer surface in the image creation device 2 (particularly, the image creation device 2Y) through a belt portion on the side where the adjustment roller 6 is disposed.

Further, in the adjustment during stationary driving, since the adjustment roller 6 rotates at a rotational speed V2 lower than the rotational speed V1 of the driving roller 32, the adjustment roller 6 rotates with a speed difference (difference of approximately 0.3%) with respect to the intermediate transfer belt 31, and thus a disadvantage occurring in a case where the rollers are rotated at the same speed is not induced for the same reason as in the case of the adjustment in the first exemplary embodiment.

Third Exemplary Embodiment

Figure 10:
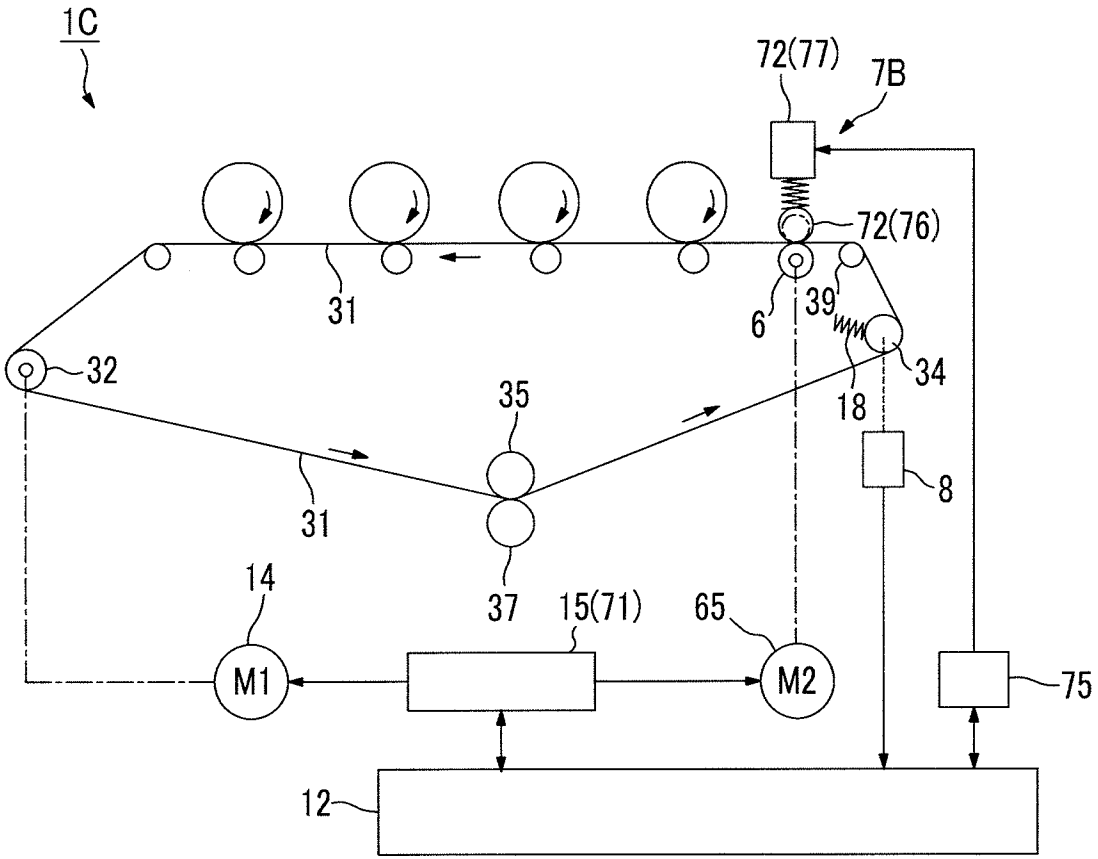
FIG. 10 is a schematic diagram illustrating main components (an adjustment roller and an adjustment unit, and the related parts thereof) in an image forming apparatus according to a third exemplary embodiment.

FIG. 10 schematically illustrates the configurations of main components of an image forming apparatus 1C according to the third exemplary embodiment.

The image forming apparatus 1C is different from the image forming apparatus 1B (FIGS. 7 and 8) according to the second exemplary embodiment in that a measurement unit 8 that measures a fluctuation in the rotational speed of an intermediate transfer belt 31 is added and that the amount of adjustment of an adjustment unit 7B is changed based on a measurement result thereof. The other configurations are the same as those of the image forming apparatus 1B according to the second exemplary embodiment. Hereinafter, different portions will be mainly described.

The image forming apparatus 1C is configured such that an encoder capable of detecting a rotational state and a rotational speed is installed as the measurement unit 8 at a rotating shaft of a supporting roller 34 that is driven to rotate with being in contact with the inner circumferential surface of the intermediate transfer belt 31 and that a measurement result (particularly, a variation in rotational speed) of the encoder 8 is transmitted to, for example, a central control unit 12 to thereby appropriately change the amount of adjustment performed by the adjustment unit 7B. The encoder 8 does not directly measure the rotational speed of the intermediate transfer belt 31, but is driven to rotate in a state where a supporting roller 34 which is a tension application roller is strongly being in contact with the inner circumferential surface of the intermediate transfer belt 31. Therefore, a rotational speed (and state) of the supporting roller 34 may be regarded as a rotational speed (and state) of the intermediate transfer belt 31.

In addition, the central control unit 12 determines the necessity of a change in the amount of adjustment performed by the adjustment unit 7B to be described later, based on information of the measurement result obtained from the encoder 8, and changes the amount of adjustment performed by the adjustment unit 7B when necessary. This is because coefficients of friction caused by friction between the inner circumferential surface of the intermediate transfer belt 31 and the surface of the adjustment roller 6 change over time due to usage for a long period of time or experimental conditions (temperature, humidity) around the image forming apparatus 10 change, which results in the necessity of suppressing a fluctuation in an effect of suppressing a speed fluctuation of the intermediate transfer belt 31 using the adjustment roller 6. For this reason, even in a case where adjustment is performed using the adjustment roller 6 and the adjustment unit 7B, when a speed fluctuation of the intermediate transfer belt 31 becomes larger than a predetermined magnitude, the amount of adjustment is changed by a necessary amount (actually, in a direction of an increase). The determination of the necessity of a change in the amount of adjustment performed by the adjustment unit 7B is set to be performed at a timing when an actual rotational speed during stationary driving becomes a speed having a speed difference exceeding 0.3% with respect to a predetermined rotational speed V1.

Hereinafter, a description will be given of an operation in a case where the necessity of a change in the amount of adjustment performed by the adjustment unit 7B is determined using a measurement result of the encoder 8.

Figure 11:
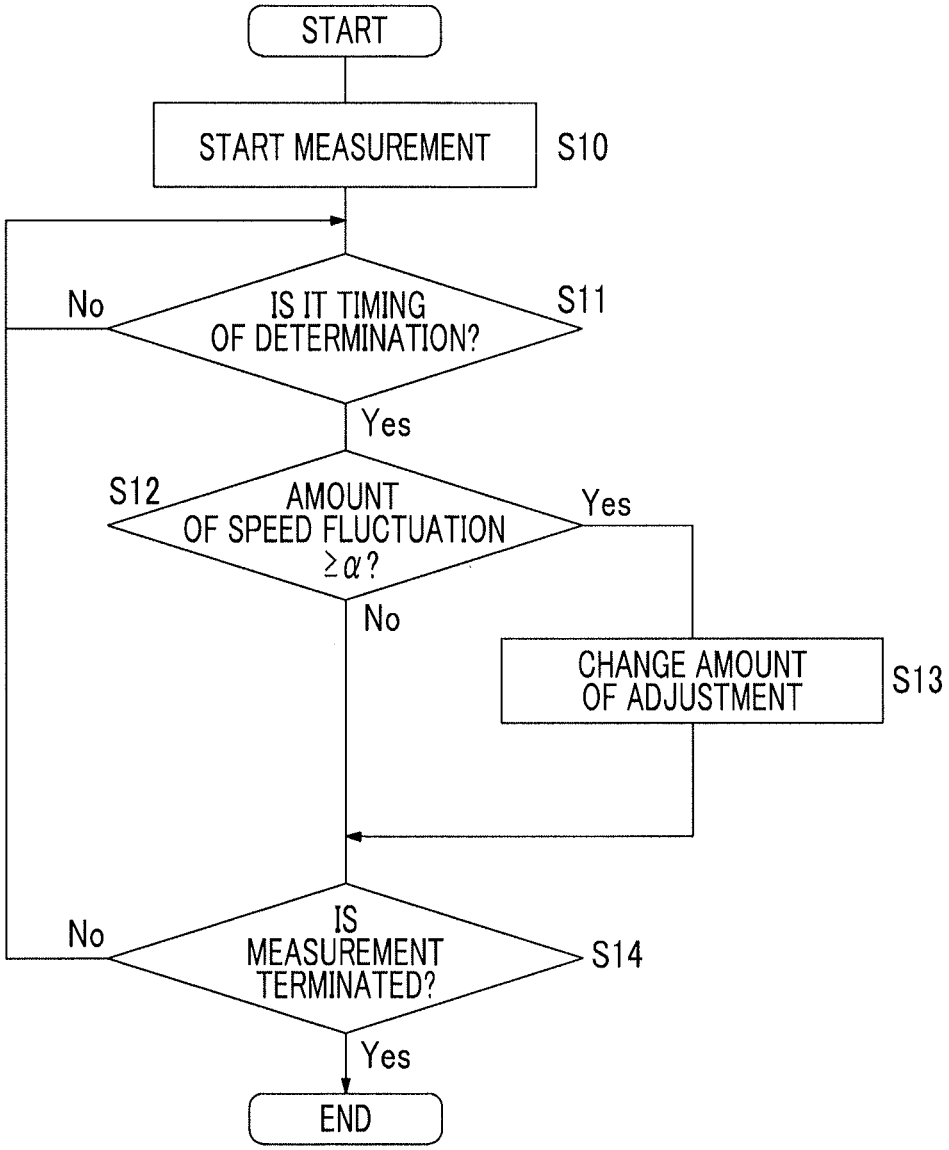
FIG. 11 is a flow chart illustrating control operations regarding the necessity of a change in the amount of adjustment performed by the adjustment unit in the image forming apparatus of FIG. 10.

In the central control unit 12, as illustrated in FIG. 11, when an image forming operation is started, the measurement performed by the encoder 8 is also started (step S10). Measurement data obtained by the encoder 8 at this time is subjected to predetermined processing and is then stored and accumulated in a storage element or the like.

Subsequently, the measurement performed by the encoder 8 is continued until a timing when the necessity of a change in the amount of adjustment performed by the adjustment unit 7B, which is caused by a speed fluctuation of the intermediate transfer belt 31, is determined. When the determination timing arrives (S11), it is determined whether or not the number of pieces of measurement data (accumulated data) regarding the amount of speed fluctuation which have been obtained by that time becomes a value equal to or greater than a threshold value a which is set in advance (S12). The threshold value a at this time is set to, for example, a value by which it may be determined that the amount of speed fluctuation has a speed difference exceeding 0.3% mentioned above.

At this time, when the number of pieces of measurement data regarding the amount of speed fluctuation is smaller than the threshold value a, a change in the amount of adjustment performed by the adjustment unit 7B is regarded as being unnecessary. Thereafter, the measurement performed by the encoder 8 is continued until a timing when the measurement is terminated arrives (S14).

On the other hand, when the number of pieces of measurement data regarding the amount of speed fluctuation is set to a value equal to or greater than the threshold value a in S12, a change in the amount of adjustment performed by the adjustment unit 7B is performed (S13). For example, the change in the amount of adjustment is performed by rewriting control data stored in driving control units 71 and 75 of the central control unit 12 or the adjustment unit 7B.

In this manner, a necessary change (adjustment) in the amount of adjustment performed by the adjustment unit 7B is performed by monitoring the actual state of the speed fluctuation of the intermediate transfer belt 31, and thus it is possible to stably obtain an effect of suppressing the speed fluctuation of the intermediate transfer belt 31 using the adjustment roller 6 and the adjustment unit 7B, which is described in advance in the second exemplary embodiment, over a long period of time in accordance with the actual state of the image forming apparatus.

Other Exemplary Embodiments

The first to third exemplary embodiments have described configuration examples in which adjustment performed by the adjustment unit 7 (7A, 7B) is performed using all of the pieces of information such as an operation timing of the intermediate transfer belt 31, the type of recording sheet 9, and a request level of an image quality. However, a configuration may also be adopted in which the adjustment is performed using one of the pieces of information or another combination of the pieces of information.

In addition, detailed contents of an operation timing of the intermediate transfer belt 31, the type of recording sheet 9, and a request level of an image quality are not limited to the contents described in the first exemplary embodiment and the like, and are set to contents effective in suppressing a speed fluctuation of the intermediate transfer belt 31. For example, contents based on a difference in thickness are described as the type of recording sheet, but may also be set to be contents based on, for example, a difference in density or grain direction (direction of fiber).

Further, adjustment performed by the adjustment unit 7 (7A, 7B) also includes adjustment performed based on the amount of fluctuation in the rotational speed of the intermediate transfer belt 31 which is measured by the measurement unit 8 described in the third exemplary embodiment. Meanwhile, a configuration in which measurement is performed by measurement unit 8 and the amount of adjustment is changed using results of the measurement at this time may also be applied to the image forming apparatus 1A according to the first exemplary embodiment.

In addition, the first to third exemplary embodiments have described configuration examples in which adjustment related to a normal force, in the adjustment performed by the adjustment unit 7 (7A, 7B), is performed by being roughly classified into three levels. However, a configuration may also be adopted in which the adjustment is performed using an adjustment level subdivided into a greater number of levels. A configuration may also be adopted in which the adjustment of a rotational speed of the adjustment roller 6 is performed using a level which is further subdivided as necessary.

The image forming apparatus may be an apparatus including plural, other than four, image creation units 2. In addition, the image creation unit 2 may be configured to be able to form an image to be transferred onto an annular belt such as an intermediate transfer belt 31, and the detailed configuration thereof is not limited to the configurations described in the first to third exemplary embodiments.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising: a plurality of image formation units that form an image; an annular belt that holds the image formed by the plurality of image formation units on an outer circumferential surface thereof and transports the image; a driving roller that rotates while being in contact with an inner circumferential surface of the belt and rotates the belt; an adjustment roller that rotates while being in contact with the inner circumferential surface of the belt and adjusts a frictional force generated between the belt and the adjustment roller; a transfer roller that is driven to rotate with being in contact with the outer circumferential surface of the belt and transfers the image on the outer circumferential surface of the belt to a recording medium, the transfer roller being disposed at a lowest portion of the annular belt; a tension application roller for applying tension provided downstream of the adjustment roller; and an adjustment unit that adjusts at least one of a rotational speed of the adjustment roller and a normal force of the adjustment roller against the belt, wherein the adjustment unit is disposed between the adjustment roller and the tension application roller, and wherein the adjustment unit adjusts the rotational speed of the adjustment roller to a speed lower than a rotational speed of the driving roller, while also adjusting the normal force of the adjustment roller against the belt to a high level.

2. The image forming apparatus according to claim 1, wherein the adjustment unit performs adjustment based on at least one selected from a group consisting of an operation timing of the belt, a type of recording medium, a request level of an image quality, and an amount of fluctuation in a rotational speed of the belt.

3. The image forming apparatus according to claim 1, wherein when the belt starts up, the adjustment unit adjusts the normal force of the adjustment roller against the belt to zero or a minimum level.

4. The image forming apparatus according to claim 3, wherein the adjustment unit sets a wrap angle of the adjustment roller with respect to the belt to approximately zero.

5. The image forming apparatus according to claim 1, wherein when the belt rotates at a constant speed, the adjustment unit adjusts the rotational speed of the adjustment roller to the same speed as a rotational speed of the driving roller and adjusts the normal force of the adjustment roller against the belt to a low level.

6. The image forming apparatus according to claim 5, wherein the adjustment unit adjusts a wrap angle of the adjustment roller with respect to the belt to a low level.

7. The image forming apparatus according to claim 1, wherein when the recording medium is a thick sheet, the adjustment unit adjusts the normal force of the adjustment roller against the belt to a high level.

8. The image forming apparatus according to claim 7, wherein the adjustment unit adjusts a wrap angle of the adjustment roller with respect to the belt to a high level.

9. The image forming apparatus according to claim 1, wherein when high quality image formation is required, the adjustment unit adjusts the normal force of the adjustment roller against the belt to a relatively high level.

10. The image forming apparatus according to claim 1, further comprising:

a measurement unit that measures a rotational speed of the belt, wherein the adjustment unit performs adjustment in accordance with a measurement result of the measurement unit.

11. The image forming apparatus according to claim 1, wherein the adjustment unit includes a speed adjustment unit that adjusts a rotational speed of the adjustment roller, and a normal force adjustment unit that adjusts a normal force of the adjustment roller against the belt.

12. The image forming apparatus according to claim 11, wherein the normal force adjustment unit increases or decreases a contact area between the adjustment roller and the belt.

13. The image forming apparatus according to claim 11, wherein the normal force adjustment unit increases or decreases a contact pressure of the adjustment roller which is received from the belt.

14. The image forming apparatus according to claim 12, wherein the adjustment roller and the normal force adjustment unit are disposed on a downstream side of the image formation unit in a rotation direction of the belt and on an upstream side of the transfer roller in the rotation direction of the belt.

* * * * *